US005941206A

United States Patent [19]

Smith et al.

[11] Patent Number: 5,941,206

[45] Date of Patent: Aug. 24, 1999

[54] ROTARY VALVE FOR INTERNAL COMBUSTION ENGINE

[76] Inventors: Brian Smith; Wayne Smith, both of 16 Caroline Chisholm Dr., South Camden, NSW 2670, Australia

[21] Appl. No.: 09/029,166

[22] PCT Filed: Sep. 18, 1996

[86] PCT No.: PCT/AU96/00593

§ 371 Date: Mar. 20, 1998

§ 102(e) Date: Mar. 20, 1998

[87] PCT Pub. No.: WO97/11261

PCT Pub. Date: Mar. 27, 1997

[30] Foreign Application Priority Data

Sep. 22, 1995 [AU] Australia ..... PN5593

[51] Int. Cl.[6] ..... F01L 7/00

[52] U.S. Cl. ..... 123/190.4; 123/190.6; 123/190.8; 123/80 BA

[58] Field of Search ..... 123/190.4, 190.5, 123/190.6, 190.8, 80 BA

[56] References Cited

U.S. PATENT DOCUMENTS

| | | | |
|---|---|---|---|
| 1,465,142 | 8/1923 | McKelvy | 123/190.6 |
| 1,970,928 | 8/1934 | Wills et al. | 123/190.6 |
| 3,892,220 | 7/1975 | Franz | 123/190.16 |
| 4,019,487 | 4/1977 | Guenther | 123/190.17 |
| 4,022,178 | 5/1977 | Cross et al. | 12/190.17 |
| 4,077,382 | 3/1978 | Gentile | 123/190.1 |
| 4,370,955 | 2/1983 | Ruggeri | 123/190.6 |
| 4,467,751 | 8/1984 | Asaka et al. | 12/190.8 |
| 4,517,938 | 5/1985 | Kruger | 23/190.6 |
| 4,751,900 | 6/1988 | Ruffolo | 123/190.6 |
| 4,852,532 | 8/1989 | Bishop | 123/190.8 |
| 4,949,686 | 8/1990 | Brusutti | 123/190 |
| 5,005,543 | 4/1991 | Triguero | 123/190.8 |
| 5,052,349 | 10/1991 | Buelna | 123/80 BA |
| 5,074,265 | 12/1991 | Ristin et al. | 123/292 |
| 5,095,870 | 3/1992 | Place et al. | 123/190.4 |
| 5,109,814 | 5/1992 | Coates | 12/190.14 |
| 5,111,783 | 5/1992 | Moore | 123/190.4 |
| 5,152,259 | 10/1992 | Bell | 123/190.2 |
| 5,154,147 | 10/1992 | Muroki | 123/190.17 |
| 5,372,104 | 12/1994 | Griffin | 123/190.2 |
| 5,417,188 | 5/1995 | Schiattino | 123/190.2 |
| 5,503,124 | 4/1996 | Wallis | 123/190.1 |
| 5,509,386 | 4/1996 | Wallis et al. | 123/190.17 |
| 5,526,780 | 6/1996 | Wallis | 123/190.6 |
| 5,529,037 | 6/1996 | Wallis | 123/190.16 |
| 5,626,107 | 5/1997 | De Blasi | 123/81 |
| 5,642,699 | 7/1997 | Brown | 123/190.2 |
| 5,706,775 | 1/1998 | Schweter et al. | 123/190.12 |

FOREIGN PATENT DOCUMENTS

| | | |
|---|---|---|
| 0258511 | 3/1988 | European Pat. Off. . |
| 611576 | 10/1926 | France . |
| 2234300 | 1/1991 | United Kingdom . |
| 9411618 | 5/1994 | WIPO . |
| 9411619 | 5/1994 | WIPO . |
| 9411620 | 5/1994 | WIPO . |
| 9411621 | 5/1994 | WIPO . |

*Primary Examiner*—Noah P. Kamen
*Attorney, Agent, or Firm*—Bliss McGlynn, P.C.

[57] ABSTRACT

A rotary valve for an internal combustion engine, comprising a cylindrical valve rotor having an inlet and an outlet port arranged in the circumferential surface thereof, and a plurality of sealing elements mounted on the valve rotor such as to subdivide the circumferential surface of the rotor body to define discrete circumferential surface zones thereon, a predetermined one of the zones being arranged such that, when the rotary valve is received within a valve bore in a cylinder head, the sealing elements about on the valve bore surface and the ports are periodically sealed off The valve serves to close off the cylinder during the compression and expansion strokes of the engine.

20 Claims, 12 Drawing Sheets

ROTARY VALVE FOR INTERNAL COMBUSTION ENGINE

FIELD OF THE INVENTION

The present invention relates to an improved rotary valve for internal combustion engines, and in particular to an improved arrangement of sealing elements for rotary valves.

1. Background of the Invention

There have been proposed different kinds of rotary valve assemblies for internal combustion engines. Of those kinds, the present invention is particularly concerned with rotary valves comprising a cylindrical or sleeve-like rotor body having separate intake and exhaust passages beginning in opposite axial sides of the rotor body. The passages terminate in an inlet and exhaust port, respectively, angularly spaced apart on the peripheral surface of the rotor body. The ports are dimensioned and arranged with respect to one another such that upon rotation of the valve rotor in a cylinder head valve bore, in which the rotary valve is rotatably supported to maintain a small clearance gap between facing surfaces of the bore and rotor body, the inlet and exhaust ports periodically align with and pass over a single transfer port in the bore surface of the cylinder head. The transfer port is in fluid communication with a combustion chamber of the engine. Periodical and properly timed opening of the transfer port allows passage of a specified air or air-fuel mixture amount, depending on whether the fuel supply is by means of injection or by a carburetor, through the valve rotor into the combustion chamber and expulsion of exhaust gases therefrom into the exhaust manifold during the induction and exhaust strokes of the engine. The circumferential surface of the valve rotor serves to close the transfer port during the combustion and compression stroke of the cycle and ideally should provide a leak-free closing of the transfer port during this part of the cycle.

2. Prior Art to the Invention

A number of different sealing systems for rotary valves have been proposed to maintain the transfer port sealed-off during the compression and combustion phases of the operating cycle of the engine.

It should be noted that some sealing systems are based on maintaining the smallest possible clearance gap between the circumferential outer surface of the rotor and the surface of the valve bore. While such sealing systems also incorporate additional sealing elements e.g. wear and temperature resistant O-rings, sealing is in essence to be achieved by the smallest possible gap size and only secondarily by sealing element interaction with the rotor and bore surfaces.

However, rotary valves relying on such sealing mechanisms have not proven successful. The present invention is not concerned with such rotary valves, but with those where a relatively small, clearance gap is maintained between facing circumferential surfaces of the rotor body and bore which does not tend to suppress gas flow, as is further described below. This radial gap has a major impact on how a sealing system can be implemented.

There are a number of published patent applications by A. E. Bishop Research Pty. Ltd. (U.S. Pat. No. 4,852,532 and WO94/11621) and Dana Corporation (U.S. Pat. No. 4,019,487) relating to rotary valves with small clearance gap and which describe seal systems providing a so called "window of floating seals". The seal system is aimed at preventing high pressure gas loss through the transfer port past the gap zone between the valve rotor and valve bore above the port during the combustion and compression cycle.

U.S. Pat. No. 4,852,532 discloses a seal system consisting of two axially spaced apart ring seals which are received in annular grooves within the valve bore, the ring seals being pre-loaded so as to rub against the outer peripheral surface of the rotor body on either side of the inlet and exhaust ports. The ring seals sealingly close the annular gap between valve rotor and valve bore along the bore axis. The system also comprises two axially extending sealing bars which are located in grooves in the valve bore surface on either circumferential side of the cylinder-head transfer port. The sealing blades are biased against the circumferential surface of the valve rotor by leaf springs. The blade length is chosen such that these abut at either longitudinal end against the axially facing sides of the ring seals. The function of the so created "seal frame" is to trap and prevent leakage of high pressure combustion gas from within the seal frame surrounding the transfer port and past the peripheral surface of the rotor body into its intake and exhaust ports.

WO94/11618 illustrates a slight modification of such sealing system in that it provides two further annular sealing elements on both axial sides of the sealing element frame described above. While it is noted in WO94/11618 that the annular sealing elements could also be received in suitable annular grooves on the peripheral surface of the valve rotor, so as to rotate therewith, the above described sealing systems all provide a sealing frame stationarily surrounding the transfer port.

There are a number of disadvantages associated with such sealing systems. Stationary sealing frames require the transfer port in the cylinder-head to have a substantial extension in circumferential direction in order to ensure good volumetric efficiency during the induction stroke of the engine. Room constraints in the cylinder-head limit the possible arc length of the transfer port in circumferential direction to about 70°–80°, thus limiting volumetric efficiency in normal engines which are not provided with additional compressors or turbo-chargers.

Furthermore, fluid cross-contamination between the inlet and exhaust ports of the valve is possible during the compression and combustion strokes, as well as during the intake and exhaust strokes. While the sealing element frame surrounding the transfer port is aimed at preventing pressure loss by sealing off the radial gap between the valve rotor and the valve bore around the transfer port, the gap is maintained elsewhere, thus allowing gas flow in circumferential direction between the exhaust and inlet ports at any time.

From patent document GB-A 2 234 300 (French) it is known to arrange the annular sealing elements and the two sealing blades on the rotor body. The sealing blades extend parallel to the axis of rotation of the valve rotor and one is located near the leading edge of the intake port and one is located near the trailing edge of the exhaust port.

While the sealing element arrangement disclosed in the GB-document addresses some of the problems perceived with the Bishop-sealing system, gas cross-contamination between the inlet and exhaust ports in circumferential direction of the rotor body is not addressed at all.

Finally, other sealing element arrangements are known, eg from U.S. Pat. No. 1,970,928 (Wills et. al.), U.S. Pat. No. 5,095,870 (Place et.al.). The arrangements there disclosed have been specifically adopted for rotary valve designs where gas exchange is not carried out through gas flow ducts or channels extending within the rotor body as is the case with the rotary valve types with which the present invention is concerned, but rather through depressions or cut-out portions in the exterior surface of the rotor body. Gas exchange is then effected during that part of the valve operating cycle where the depression(s) communicate with the transfer port of a cylinder and a corresponding intake and exhaust manifold duct within the cylinder head. The sealing mechanism is different.

SUMMARY OF INVENTION

The present invention seeks to provide an alternative sealing systems for rotary valves of the initially mentioned kind.

According to the present invention there is provided a rotary valve for controlling the supply and exhaust of fluid to and from a combustion chamber of an internal combustion engine, comprising a valve rotor having a cylindrical rotor body with an inlet and an outlet channel extending therethrough and which channels respectively end in an inlet and an outlet port formed in circumferentially spaced apart relationship on a circumferential surface of the body and in an inlet and an outlet opening formed in opposite axial end surfaces of the body;

a valve bore having a transfer port in its circumferential surface communicating the interior of the bore with the combustion chamber, the valve rotor being received co-axially within the valve bore so as to maintain a small radial clearance gap between the circumferential surface of the rotor body and the facing valve bore surface, the valve rotor arranged for synchronised rotation with the stroke timing sequence of the operating cycle of the engine such that the inlet and outlet ports pass over the transfer port for periodically enabling fluid exchange therethrough; and a sealing system comprising at least two sealing rings mounted on the rotor body on opposite axial sides of the inlet and outlet ports and a plurality of longitudinal sealing blades mounted on the rotor body and extending between the sealing rings, the sealing rings and blades disposed to bridge the radial clearance gap and rub against the circumferential bore surface;

wherein the circumferential surface of the rotor body is notionally subdivided into four circumferentially successively arranged zones corresponding to an induction, a compression, a combustion and an exhaust stroke of the engine operating cycle, wherein the intake port located in the induction zone extends for an arc length of about 1.571 to 2.094 radians, wherein the compression and combustion zones include an ignition zone overlapping both said zones and which has a circumferential length greater than that of the transfer port, and wherein at least one of said sealing blades is located at the beginning of the induction zone, at the beginning and at the end of the ignition zone, at the beginning of the exhaust zone and between the exhaust and induction zones, respectively whereby the arrangement of sealing rings, sealing blades and thereby framed valve rotor zones is such that charge compressed during the compression stroke and combustion gases created during the combustion stroke are substantially prevented during these strokes from passing from the transfer port into the inlet and outlet ports and openings of the rotor body and fluid exchange between the inlet and outlet ports of the rotor body is also substantially prevented during these strokes.

In other words, the invention provides a rotary valve with a system of discrete sealing frames which rotate with the rotary valve and which effectively seal off from one another five surface zones thereon when the rotary valve is received in the valve bore of the cylinder head, the surface zones being correlated with the strokes performed during one operation cycle of the engine.

The sealing system creates discretely framed "gap volume zones" which are defined between the facing circumferential surfaces of the rotor valve body and the valve bore and the facing side surfaces of the sealing blades and rings, discrete gap volume zones corresponding to the exhaust, induction, compression and combustion stroke of a working member (eg, a piston) in a combustion chamber (eg, a cylinder) to which such rotary valve is assigned. This effectively subdivides and seals-off from one another in circumferential direction discrete rotor surface zones, which rotate with the rotor and periodically pass over with the transfer port. Thus, sealing is not only effected around the transfer port in the cylinder head but for each of said zones separately, or part zones thereof. This increases sealing efficiency in circumferential direction. Furthermore, by arranging the sealing elements on the valve rotor body, the dimensions of the cylinder head transfer port in circumferential direction can be reduced while ensuring optimum volumetric efficiency. It is, amongst other factors, the correlation between cylinder head transfer port size, valve intake and exhaust port dimensions and timed rotation of the valve rotor with the crank shaft of the engine, that is the opening and closure time windows, that determine volumetric efficiency. The rotary valve design as defined above has an optimised valve rotor intake port size such that the actual time interval in which air or air-fuel mixture ("charge") can actually be induced through the valve rotor into the cylinder during the induction stroke is maximised. This makes the "intake window" or valve opening rate during induction completely independent from any constraints otherwise imposed by the seal systems used in the prior art rotary valves described above. In other words, the intake port has an optimised size such that it registers and is in fluid communication with the transfer port throughout the time period in which vacuum is present in the engine cylinder to draw in charge into the combustion chamber without cross-contamination with the exhaust port.

Given the possibility of reducing the circumferential extension of the transfer port it is also possible to prevent, if required, that both the exhaust and the intake port simultaneously register or overlap with the transfer port during rotation of the valve. This allows to prevent cross-contamination flow between exhaust and intake ports when passing over the transfer port during the transition between exhaust and induction stroke.

The inclusion of the sealing elements on the rotor body allows the valve ports to be dimensioned independently from the transfer port size and to avoid overlap without sacrificing volumetric efficiency. This also results in cleaner emission and, thus, reduced pollution.

Further, by arranging the sealing blades on the rotor body it is possible to dispense with separate biasing elements aimed at ensuring that the blades abut against the valve bore surface. This "biasing" can be provided by the centrifugal forces acting on the sealing blades during rotation of the rotor body, which thus ensures proper and revolution speed dependent abutment. Whilst centrifugal forces to which the rotor sealing blades are subjected to at low engine speeds are small, and therefore abutment pressure between valve bore surface and the sealing blades is reduced during this stage, it is believed sufficient to provide proper sealing efficiency. Pressure and gas loss from the discrete gap volume zones is not prevented during starting of the engine, which leads to reduced compression ratios. Such reduced ratios, however, are not a problematic, but are in many instances advantageous in aiding engine start-up against reduced reaction forces otherwise experienced at high compression ratios. On the other hand, if desired, it is possible to arrange suitably shaped (e.g. leaf) spring elements within all or some of the axial grooves of the rotor body such as to provide additional, rotor speed independent, biasing means which positively abut the sealing blades against the valve bore surface.

Because the exhaust and intake ports are sealed-off from one another by the annular sealing elements and the axial sealing elements disposed on either side of said ports, and the respective exhaust and inlet passages terminate at axially opposite end faces of the rotor body, the exhaust and air/charge manifolds can significantly be sealed-off from one another.

By appropriately dimensioning the said partial chambers as defined in claim 3 and 4, and using the valve bore volume unoccupied by the valve rotor body on either axial side thereof, it is possible to provide useful intake and exhaust chambers within the cylinder head. The intake and exhaust chambers are effectively sealed-off from one another in axial flow direction by the annular sealing elements (ie sealing ring) on the rotor body. The volume of the intake chamber can be dimension so as to correspond with the swept volume of the cylinder of the engine to which the valve is assigned.

The preferred features of claim 5 enable a more compact design than is the case with sleeve/or tubular-like rotary valves. It is of course also possible to mount a given number of rotor bodies fixed against rotation and axial movement on a common load bearing shaft.

Advantageously, the sealing rings are received in the associated annular grooves in the rotor body surface with a slide fit, with minimum possible axial play, such that relative rotational movement between sealing rings and rotor body is permitted during rotation of the valve. This measure reduces friction forces and wear between rotary valve and valve bore while maintaining adequate sealing between facing surfaces thereof. When using conventional piston-type sealing rings with clearance gap it is preferable to arrange two sealing rings in each groove, thereby reducing the statistical possibility of having the gap in the rings coincide in their rotational position with the circumferential location of the transfer port and reduce sealing efficiency during the combustion and compression strokes during these alignments. Alternatively, a single sealing ring can be held stationary against rotation by any conventional means, such as a fixing lug, within the receiving groove in a rotational position which does not coincide with the discrete circumferential surface zones of the rotor body which are correlated with the combustion and/or compression stroke of the engine. Alternatively, a discontinuous sealing ring having overlapping and stepped portions or legs can be employed, thus eliminating ring end clearance gaps.

Advantageous forms of the sealing blades or bars are defined in claims 11 and 12. The parallelepiped sections can be dimensioned to fit side by side with slide fit within the axially extending grooves, each having a length which is smaller by a predetermined amount than the axial groove length and the distance between the surfaces of facing annular sealing elements in between which the composite axial sealing elements are to be received abutingly. The biasing means, which can be a simple spring, pushes the sections in opposite axial directions such that one section abuts with its one terminal axial face against the adjacent annular sealing element and the other section abuts with its opposite terminal axial face against the other annular adjacent sealing element. The predetermined amount can be chosen such as to compensate for manufacturing plays between abutting parts and take up an amount equivalent to the thermal expansion of a one-part seal element between cold and overheating conditions of the engine, thus avoiding seiting.

Thus, such two-part axial sealing blades or elements allow to maintain gap-free contact with the sealing rings respectively located at both axial ends thereof independently of engine temperature conditions and manufacturing plays. Thus, an effective "sealing frame" is provided around each one of the circumferential surface zones of the rotor body to seal-off the radial gap between rotor surface and bore surface around said zones.

As indicated above, the circumferential surface of the rotor body is notionally divided into four circumferentially, successively arranged zones which are respectively associated with the induction, compression, combustion and exhaust stroke performed by a piston in the cylinder of an engine operating in four stroke mode. The circumferential length of said surface zones can each be chosen such as to exactly be correlated with the respective stroke length between bottom dead centre ("BDC") and top dead centre ("TDC") of the piston. However, since vacuum generated during the actual induction stroke between TDC and BDC is still present in the cylinder after the piston passes BDC and starts moving upwards in the compression stroke, the intake port located in the induction zone can be extended for an arc length greater than $\pi/2\times r$ (where r is the radius of the valve rotor body) or 1,5708 radians, to take advantage of the "compression lag". This enables longer induction time window lengths in which air/charge can actually be fed into the cylinder.

For example, the actual intake port length ("IPL") in circumferential direction for a four stroke engine can be expressed as $$IPL=\tfrac{1}{2}\pi\times d(180^\circ+\alpha^\circ+\beta^\circ)\times\tfrac{1}{360}^\circ\times\tfrac{1}{2}$$

where d=diameter of cylindrical rotor body, 180° corresponds to the crank shaft rotation during the induction stroke between TDC and BDC; $\alpha^\circ$ corresponds to a predetermined value of crank shaft rotation in the exhaust stroke before reaching TDC at the beginning of the induction stroke, i.e. a scavenging overlap; $\beta^\circ$ corresponds to a predetermined value of crank shaft rotation in the compression stroke after BDC at the end of the induction stroke, that is the value of crank shaft rotation corresponding to the "compression lag".

The actual intake window length ("IWL") is then:

$$IWL=IPL+TPL$$

where TPL is the transfer port length.

If the size of the transfer and intake ports is chosen to be equal, and assuming a compression lag of 30° and scavenging overlap of 10°, then the port sizes equate each to 55° arc angle opening or 0.96 radians, the actual length being:

$$TPL=IPL=55^\circ\times\tfrac{1}{360}^\circ\times\pi\times d$$

Of course, $\alpha^\circ$ and $\beta^\circ$ can be 0° or any other value as appropriate in the circumstances. It is to be understood that specific values can easily be determined by the skilled addressee without the necessity for any inventive input. However, for practical purposes, it is believed that the circumferential length of the intake port should not exceed an arc angle of about 120° or 2.094 radians.

Further, the successive compression and combustion zones on the rotor body share "ignition (part) zone" which has a predetermined arc length which is equal to the circumferential length of the transfer port plus the length of an arc section of the rotor surface associated with 5°–20° crank-shaft rotation on either side of TDC of the compression stroke of the piston. This ignition zone aligns with the transfer port during the critical ignition phase overlapping the compression and combustion strokes, which phase extends from just before the charge in the combustion chamber is ignited and the piston is in a position just before or at TDC to when the piston is already moving downwards in the combustion stroke after maximum combustion pressure is experienced.

Thus, the rotor body is advantageously provided as indicated above with one sealing blade on either side of the induction and the exhaust zones and at least one between these zones, to prevent fluid cross-contamination between the ports in said zones, and one sealing blade at either end of the abovementioned ignition zone to ensure proper sealing of the clearance gap between rotor body surface and bore surface during the first critical moments immediately prior to ignition and shortly thereafter.

Because in carburetor type-engines there is always a pressure differential between the intake and exhaust manifold, which is also present at the intake and exhaust ports of the rotary valve, it is advantageous to seal-off the discrete zones from one another in which these ports are located such as to substantially prevent gas flow therebetween.

In a further aspect of the present invention there is provided a cylinder head-rotary valve assembly for an internal combustion engine in accordance with claim 13.

While the working temperature of the rotary valve is (partly) controlled by the temperature of the air/charge supplied through the valve into the combustion chamber, it is possible to additionally use existing cooling systems of the engine. The zone surrounding the valve bore may be cooled by circulating engine coolant through suitably formed cavities within the cylinder-head. Cooling of the bearings of the rotary valve can be aided by any conventional means. Separate lubrication of the bearings, however, could be dispensed with for specific applications, where lubricant contents in the charge and exhaust gases is sufficient to ensure proper lubrication of rotary parts or self-lubricating contained bearings are used.

The bearing means may be any suitable conventional bearings used in automotive engines such as roller bearings, journals, bushes and the like, depending on the engine type, operation parameters and design life of such cylinder head assembly. The number of bearing elements can be determined as appropriate. The drive means may comprise, in a cylinder head for multi-cylinder engines, journaled couplings between individual valve rotors, in case discrete rotary valves are used, or other types of couplings to ensure synchronicity of rotation of the rotary valve rotors, and a synchronising mechanism coupling one shaft end of the rotary valve(s) with the crank shaft of the engine, such as a pinion and chain drive.

In modification of the embodiment in accordance with claim 13, the valve bore may be provided by a separate, sleeve-like rotor liner as per claim 14.

The present invention and different aspects and advantages thereof will be more fully understood from the following description of preferred embodiments thereof given with respect to the accompanying drawings.

MODES OF CARRYING OUT THE INVENTION

Figure 5:
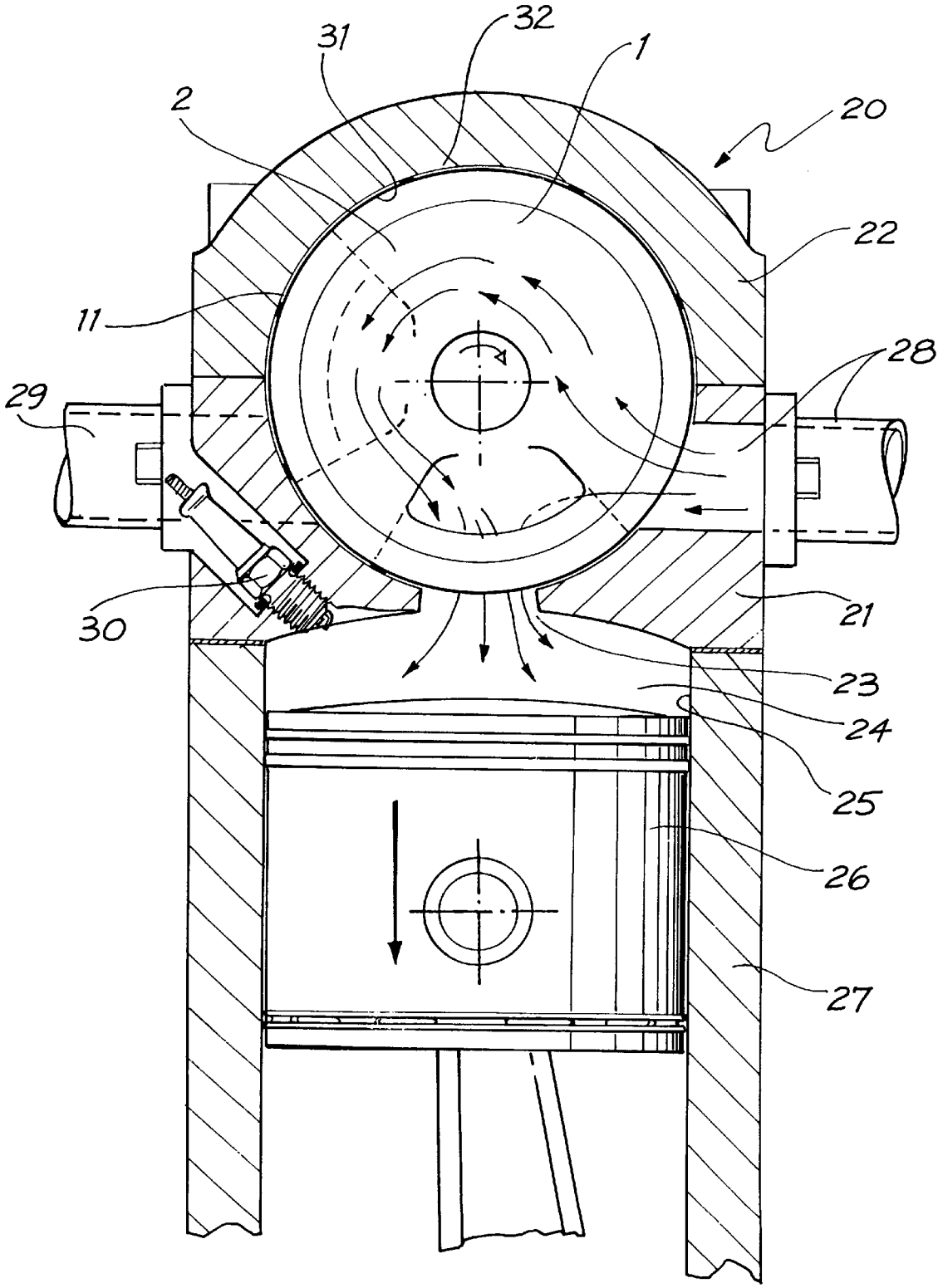
FIG. 5 is a schematic cross-section through a cylinder head-rotary valve assembly in accordance with the present invention.
Figure 6:
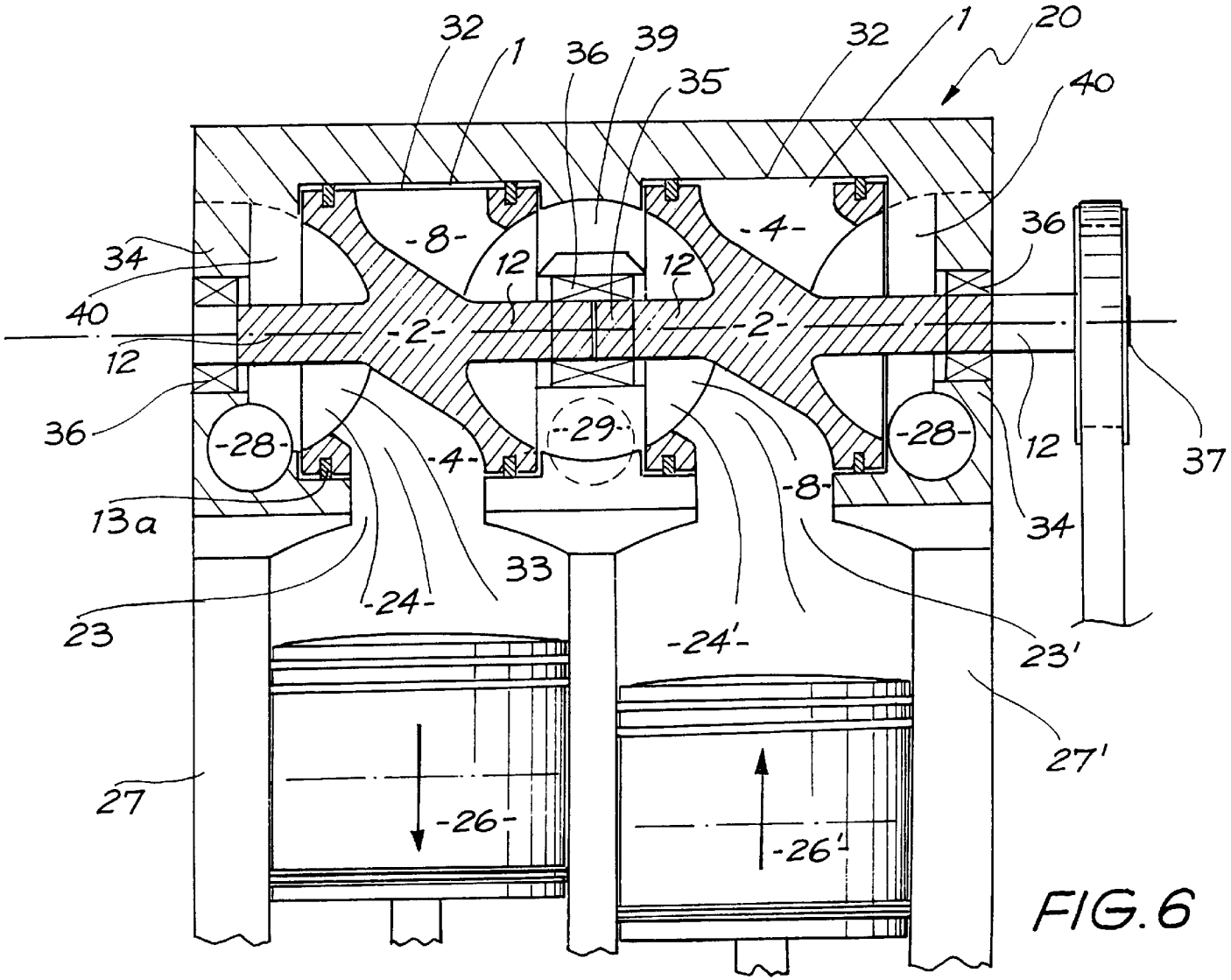
FIG. 6 is a schematic longitudinal section through a cylinder head-rotary valve assembly for a multi-cylinder internal combustion engine in accordance with the present invention, the rotor bodies being illustrated in a section similar as FIG. 4.

Referring first to FIGS. 5 and 6, there is schematically illustrated a rotary valve 1 which is supported for rotation in a valve bore 31 of a cavity in a cylinder head 20 of an internal combustion engine. While FIG. 5 schematically illustrates a one-cylinder engine, it is understood that the cross-section according to FIG. 5 is also illustrative of a two-/or multicylinder internal combustion engine (see FIG. 6), in which each engine cylinder 27, 27' is provided with one rotary valve 1, 1' to control in known manner the opening and closing of a rectangular transfer port 23, 23' in the cylinder head 20 associated with each cylinder 27, 27'. The transfer port 23, 23' provides fluid communication between the combustion chamber 24, 24' of the cylinder 27, 27' and the intake and exhaust manifold channels 28, 29 in the cylinder head 20 via the rotary valve 1, 1'. A reciprocating piston 26, 26' is arranged in cylinder 27, 27' in a known manner to drive a crank shaft (not shown) of the engine.

The cylinder head 20 can be provided as a one piece housing (as is commonly the case with one-cylinder engines) or comprise lower and upper cylinder head sections 21 and 22. The cylinder head 20 is provided with suitably formed bearing pedestals 33 in the cylinder head cavity and bearing support end plates 34, which are arranged at both axial ends of the valve bore 31, for rotatably supporting the rotary valve(s) 1, 1' by suitable roller bearings 36. In a multi-cylinder engine, adjoining rotary valves 1, 1' are coupled for synchronous rotation via suitable coupling journals, schematically illustrated at 35 in FIG. 6. The drive for the rotary valve(s) is provided by a conventional sprocket and chain drive 37 coupled to the crank shaft of the engine for timed rotation therewith. In a four-stroke type engine, rotary valve rotation speed is half crank shaft rotation speed so that exhaust and intake ports provided on the rotor body of the rotary valves, as will be described herein below, will coincide once during each revolution of the rotary valve 1, 1' with the transfer port 23, 23' in the cylinder head 20 during a full cycle comprising an induction, a compression, a combustion and an exhaust stroke of the piston 26, 26' in the respective cylinder 27, 27'.

As can be best seen from FIGS. 5 and 6, the cylindrical rotor body 2 of the rotary valve 1 is supported within the valve bore 31 so that there is a small radial clearance gap 32 between the circumferential surface 11 of the rotor body 2 and the internal surface of the valve bore 31 circumferentially enclosing the rotor valve body 2. The clearance gap 32 is provided, amongst other reasons, to take-up any thermal expansions and contractions the rotary valve and the cylinder head may be subjected to during operation of the engine and to inhibit seizing of the rotary valve within the cylinder head. The gap 32 also ensures that friction during rotation is limited to bearing point friction. It is to be understood that the expression "small clearance gap" as used herein is not intended to be necessarily understood as the smallest possible gap which would still permit rotation of the rotor body without the circumferential surface thereof making contact with the valve bore surface, that is a sealing gap, but could be, for example, a ½ mm gap clearance or smaller.

Figures 1, 2:
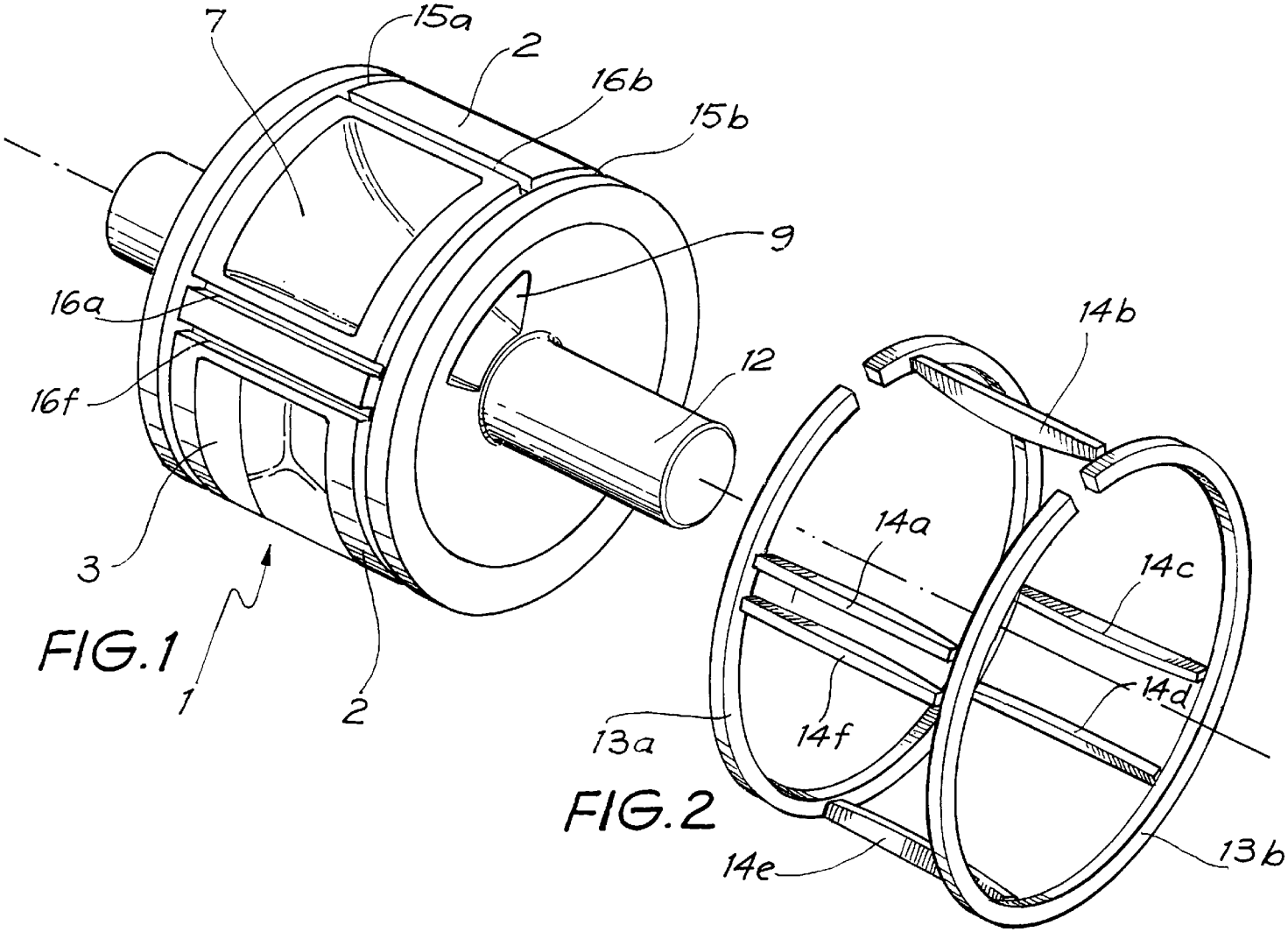
FIG. 1 is a perspective view of a rotor body of a rotary valve in a first embodiment according to the invention.
FIG. 2 is an isometric view of a system of rotating sealing elements arranged in spaced relationship such as to be received in respective grooves in the rotor body illustrated in FIG. 1.
Figure 4:
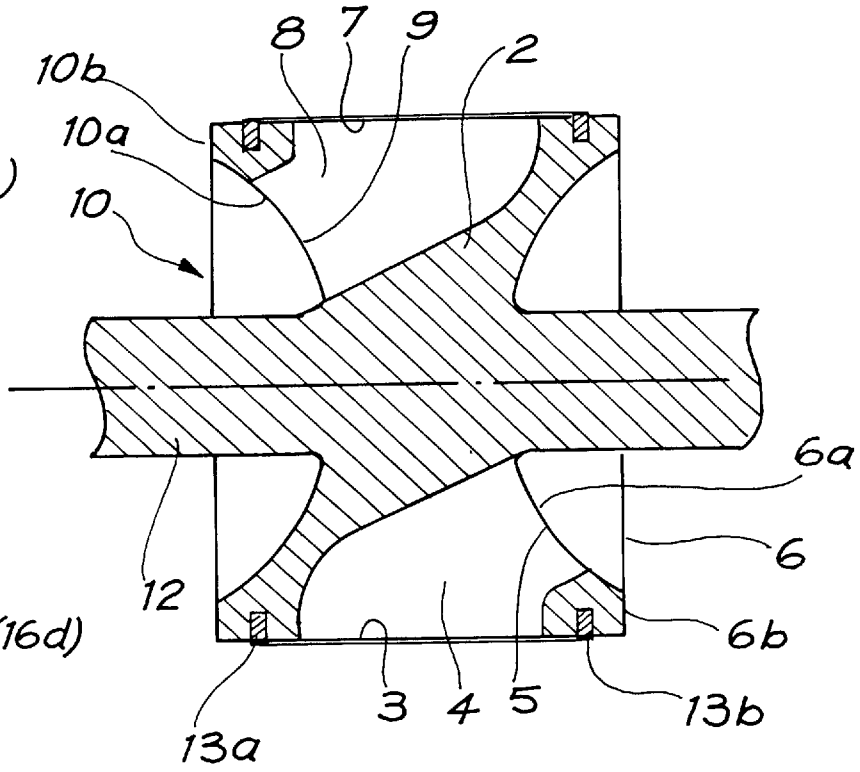
FIG. 4 is a longitudinal section of the rotor body according to arrows A–B in FIG. 3.

Turning now to FIGS. 1 4, there is illustrated in different representations a first embodiment of a rotary valve 1 according to the invention. The rotary valve 1 comprises a cylindrical rotor body 2 having an integrally formed central load bearing shaft 12 extending from both axial end faces 6 and 10 of the rotor body 2. As best is seen in FIGS. 1 and 4, each axial end face 6, 10 has a central concave surface zone 6*a*, 10*a* surrounding the shaft ends and a planar annular surface 6*b*, 10*b* radially outward therefrom. The rotor body 2 has on its circumferential surface 11 a rectangular inlet port 3 which extends via an inlet channel 4 through the rotor body 2 to terminate in an inlet opening 5 in the recessed surface 6*a*. A rectangular exhaust port 7 is provided on the circumferential surface 11 with angular spacing from the inlet port 3. The exhaust port 7 extends via an exhaust channel 8 through the rotor body 2 to terminate in an exhaust opening 9 in the recessed surface 10*a* on the opposite axial side of the rotor body 2. The specific size and path of the inlet and exhaust channels 4, 8 is dictated, amongst others, by fluid-dynamic parameters.

As can be seen in FIG. 6, in a cylinder head for a multiple cylinder engine, the rotors 2 are received such that facing concave surfaces of adjoining valve rotors 2 form together with the interposed valve bore zone, where the rotary valve 1, 1' are jointly supported at 35, a chamber 39 in the cylinder head 20 common to two valves; in the specific valve arrangement of FIG. 6, since the facing concave surfaces are those in which the exhaust channels of the respective valves open, the chamber acts as a common exhaust chamber from which a single exhaust manifold channel 29 leads into the exhaust system of the engine. While not illustrated in FIG. 6, similar considerations apply in forming a common intake chamber between adjoining rotary valves where the facing concave surfaces are those in which the inlet channels of the respective valves open. In the two-cylinder arrangement illustrated in FIG. 6, two intake chambers 40 are formed at either end of the cylinder head 20 by the concave recessed surfaces in which the respective inlet channels of the rotor valves open and by the respectively adjoining valve bore zones sealingly closed by the bearing support end plates 34. An intake manifold line 28 communicates with each intake chamber 40 and with an air intake system of the engine in known manner.

As has hereinbefore been described, each rotary valve 1, 1' is timed with the reciprocating movement (stroke) of the respectively associated piston 26, 26'. Thus, discretely defined circumferential surface zones of the rotor body can be co-related to and can be said to be associated with a respective one of the strokes of the piston performed during one full cycle, i.e. the rotor body surface 11 can be subdivided in an exhaust, induction, compression, and combustion surface zone.

The rotor body 2 is provided with a number of sealing elements 13*a*, 13*b*, 14*a*–14*f* to provide so-called sealing frames surrounding the above-referred to discrete surface zones of the rotor body surface 11. The sealing elements 13*a*, 13*b*, 14*a*–14*f* co-operate with the inside surface of the valve bore 31 to create sealed-off volume zones in the annular gap volume between rotor and bore surface, thereby substantially preventing gas-flow between said framed volume zones.

Figure 14:
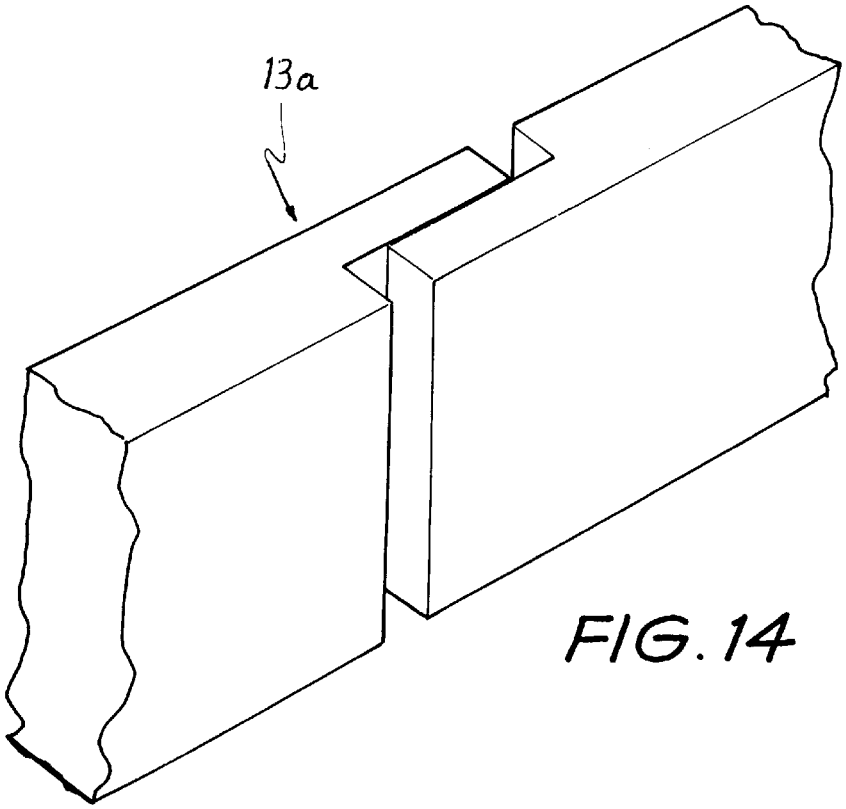

As best seen in FIGS. 1 and 2, the rotor body 2 has two circumferentially extending grooves 15*a* and 15*b* located on either side with distance from the edges of the intake and exhaust ports 3 and 7. In these annular grooves 15*a* and 15*b* are respectively positioned one sealing ring 13*a*, 13*b*. While conventional piston rings 13*a*, 13*b* having a small gap in the circumferential extension may be used, FIG. 14 shows a preferred form in which the free ends of the sealing ring are stepped and overlapped to provide a gap-free annular sealing element. The sealing rings 13*a*, 13*b* prevent gas passage from the combustion chamber 24 through the transfer port 23 along the valve bore 31 in axial direction past the axial end faces of the rotary valve. The sealing rings 13*a*, 13*b* and the grooves 15*a*, 15*b* are dimensioned so as to provide a slide fit which allows relative rotation of the rings with respect to the rotor body 2 while maintaining minimum possible axial play. The sealing rings 13*a*, 13*b* are preloaded such that when received in their respective grooves 15*a*, 15*b* they biaisingly abut against the circumferential surface of the valve bore 31 but are not inhibited from rotation. When the sealing ring comes to lie with its stepped-overlapping legs within the rotor surface zones associated with the compression and combustion zones, the compression and combustion pressure will serve to press the ring ends against the axially outward facing surface of the annular groove, thus enhancing gap-leakage prevention past the sealing ring ends (see FIG. 14).

Figure 13:
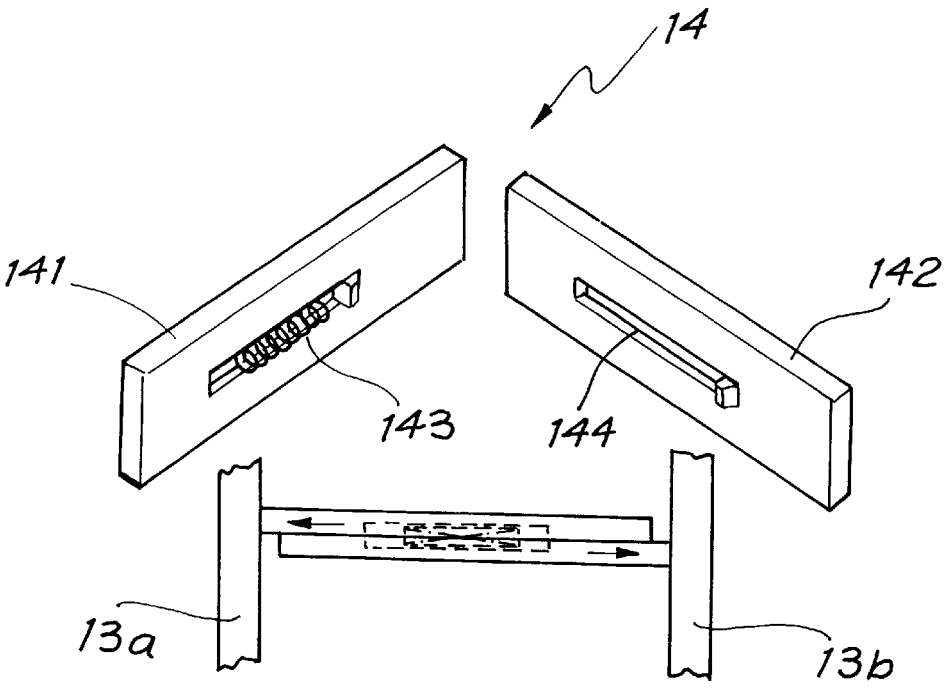
FIGS. 13 and 14 are isometric detail illustrations of an axial sealing element and a annular sealing element, respectively, as used in the rotary valves according to the invention.

Passage of gas from the combustion chamber 24 through the transfer port 23 in a circumferential direction of the rotor body 2 is restricted or limited to discrete surface zones by six (6) axially extending sealing blades 14*a*–14*f*, which are angularly spaced from one another along the circumference of the rotor body surface 11 and received in correspondingly shaped and spaced axial grooves 16*a*–16*f* extending between the annular grooves 15*a,* 15*b*. The length of the parallelepiped shaped axial sealing elements 14*a*–14*f* is chosen such that when received in their respective grooves 16*a,* 16*b* they abut with their axial end faces against the respectively adjacent sealing rings 13*a,* 13*b*. One way to ensure a sealing abutment in axial direction is to provide a two-piece sealing blade 14 (FIG. 13) consisting of two parallelepiped blade sections 141, 142 having a groove and feather means 144, 145 for linear-reciprocating alignment such that the two plate sections can move in axial direction with respect to one another in a sliding manner. A spring 143 is arranged within the grooves such as to work together with the feather-groove means to provide a telescopically extendable and retractable, variable length composite blade design as illustrated in FIG. 13, which maintains a sealing abutment of the axial end faces of the sealing blade between the sealing rings 13*a,* 13*b*. It should also be noted that the surface of each axial sealing blade 14*a*–14*f,* which abuts against the valve bore surface can be formed arcuate so as to conform with the valve bore surface, that is said abutment surface has a radius of curvature corresponding to that of the valve bore.

Turning again to FIGS. 1 and 3, one groove each is located adjacent either circumferential end of the intake port 3 and exhaust port 7 of the rotor body 2. That is, the axial sealing blades 14*a* and 14*b* on either side of the exhaust port 7 and the hereinbetween extending arc sections of the sealing rings 13*a* and 13*b* provide above mentioned sealing frame for the discrete exhaust zone of the rotor body, and the axial sealing blades 14*b* and 14*s* on either side of the intake port 3 and the hereinbetween extending arc sections of the sealing rings 13*a* and 13*b* provide a sealing frame for the discrete induction zone of the rotor body.

Figure 3:
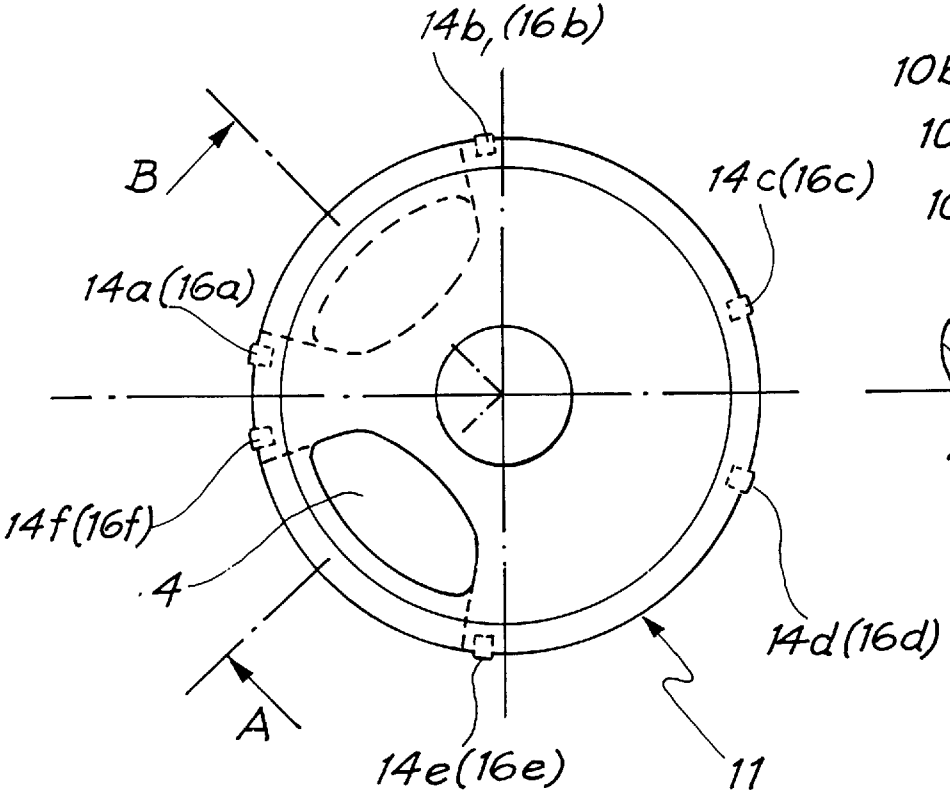
FIG. 3 is an axial plan view of the rotor body of FIG. 1.

The other two grooves 14*c* and 14*d* are located on the circumference on either side of an arcuate surface zone sector of about 20°–35° (0.3491–0.6109 radians) as can be seen in FIG. 3. The position and relation of said surface zone with respect to the induction and exhaust surface zones is determined by the timing relationship between rotary valve and crank shaft rotation, that is the stroke sequence and length of stroke. The grooves 14*c* and 14*d* are located such that the sealing blades 16*c* and 16*d* received therein come to be positioned during rotation of the rotary valve 1 in the valve bore 31 on either circumferential side of the transfer port 23 in the cylinder head 20 during a time period extending immediately before ignition of the charge is effected in the combustion chamber of the cylinder before the piston reaches TDC to when the piston has passed TDC and is on its downward combustion stroke after maximum combustion pressure was achieved in the combustion chamber. During this period, the crank shaft rotation encompasses an angle of about 10°–40° (0.1745–0.6981 radians).

The above given value of 20°–35° angle opening for the surface sector (equivalent to 0.3491–0.6109 radians), also referred to as ignition surface zone, is exemplarily only and chosen for the illustrated embodiment. It is evident that the specific circumferential length of the rotor surface which is to cover the transfer port during the above described pre and-post ignition time window will vary depending on the circumferential extension of the transfer port. Thus, the ignition surface zone will have a circumferential length which is greater that the one of the transfer port in the cylinder head for which the rotor valve serves as a periodical closure, sealing and opening means.

The circumferential length of the intake port 3 is preferably chosen to be about 1.571 to about 2.094 radians, which equates with an arc length having an angle opening of 90° to 120°. This size is believed to be optimal for volumetric efficiency.

As has been stated hereinbefore, the axial sealing elements (blades) 14*a*–14*f* are mounted in their receiving grooves 16*a*–16*f* with glide fits such that they will abut against the surface of the valve bore 31 under the influence of centrifugal forces during rotation of the valve 1. But for the lubricant properties of the fuel and exhaust gases passing through the rotary valve into and from the combustion chamber, the sealing rings and blades may not require a separate lubricant; this in turn requires a specific material selection for the sealing elements, which could be made out of conventional materials used for known piston sealing rings as well as ceramics, composite ceramics and the like, which are chose such as to minimise friction and wear between moving parts as well as taking into consideration the thermal loads the elements are subjected to.

Figure 7:
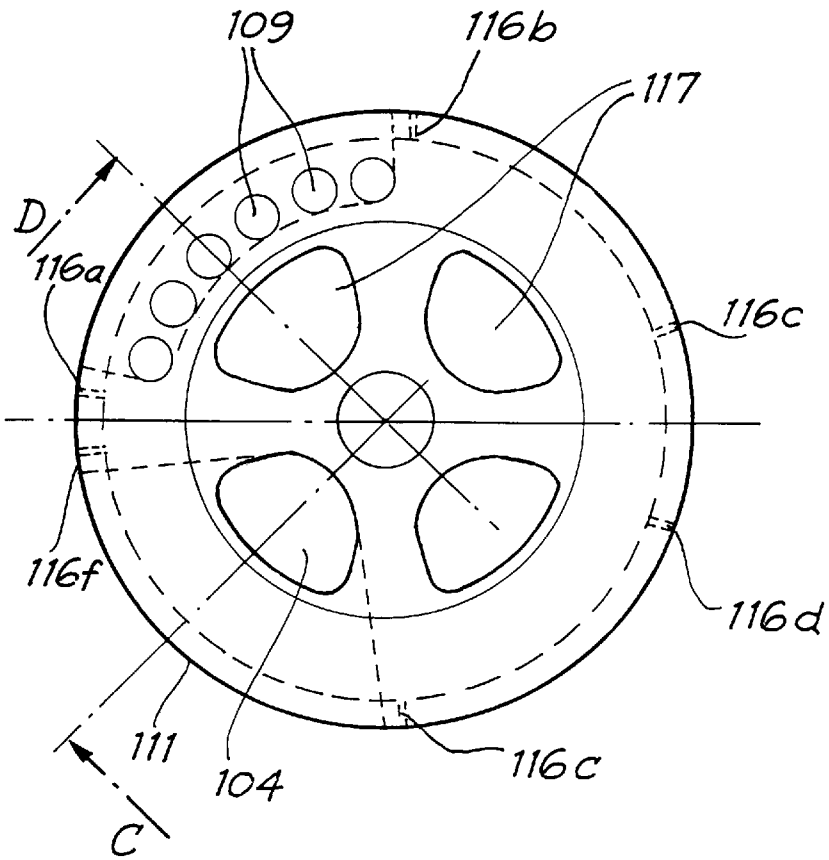
FIG. 7 is a plan view in axial direction of an alternative rotary valve.
Figure 8:
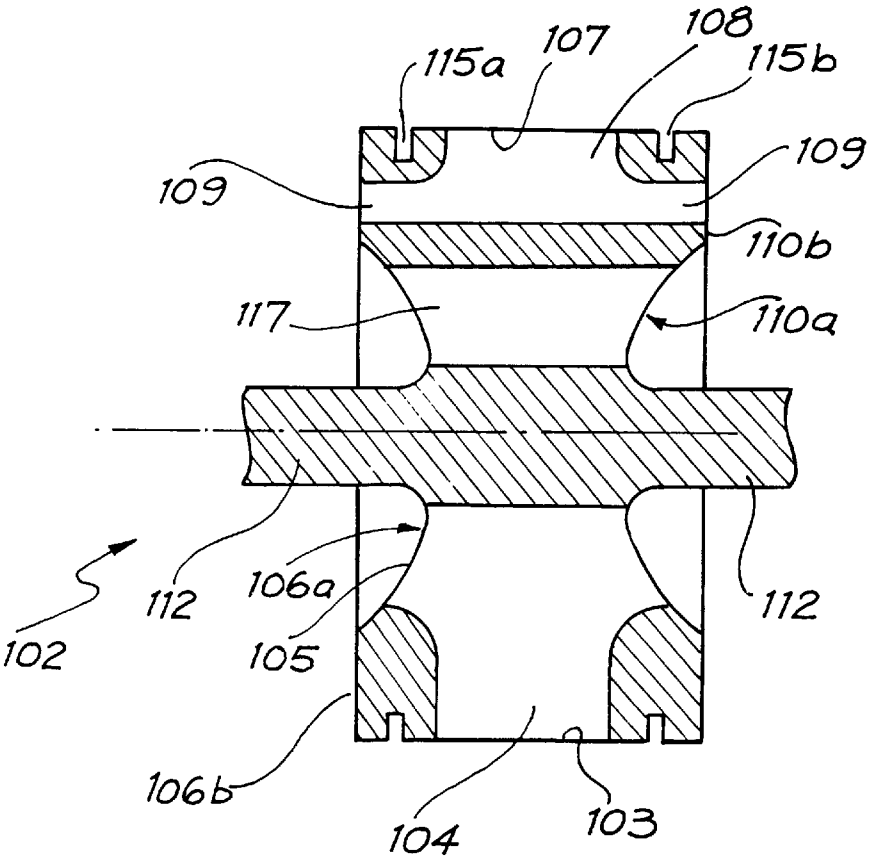
FIG. 8 is a longitudinal section of the rotary valve of FIG. 7 along arrows c–d.
Figure 12:
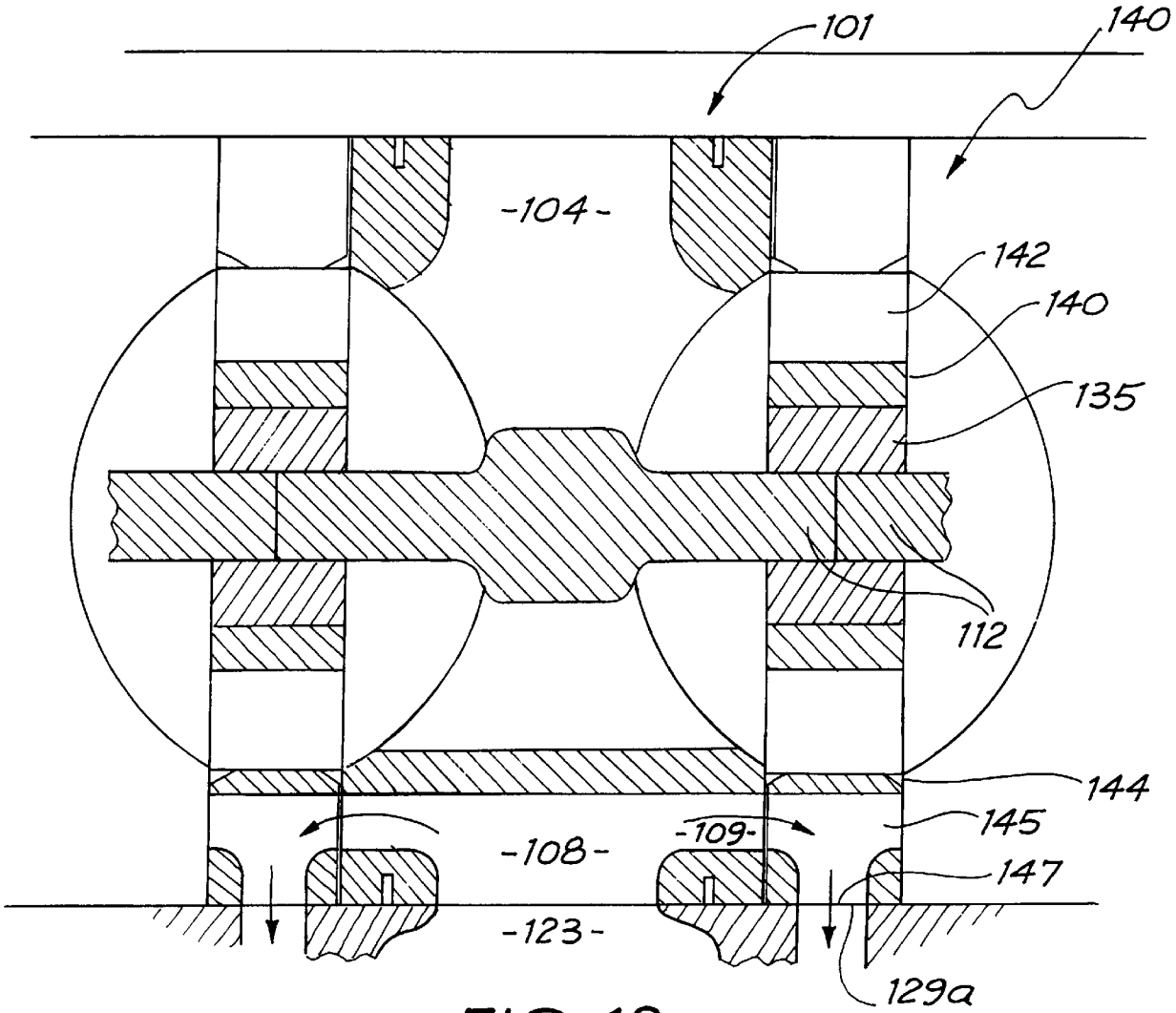
FIG. 12 is a schematic illustration showing a rotary valve according to FIGS. 7 and 8 co-operating with two support plates according to FIG. 10 and 11.

A different type of rotor body is illustrated in FIGS. 7–8 and 12. The sealing system consisting of sealing rings and blades forming above described discrete sealing frame is the same as described hereinbefore, and thus any reference to the discrete rotor surface zones and sealing frame arrangement should be understood in light of above given description, unless otherwise stated.

The circumferential surface 111 of the rotor body 102 has two annular grooves 115*a* and 115*b,* one each located axially adjacent the inlet and exhaust ports 103 and 107, which themselves are sized and located on the circumferential surface 111 as previously described with reference to the first embodiment. A total of six axial grooves 116*a*–116*f* are angularly spaced from one another on the circumferential surface 111 in similar locations as described above. The sealing elements to be received in the annular and axial grooves have been omitted from FIGS. 7 and 8 for clarity of illustration purposes but are the same as illustrated in FIG. 2 and described above.

In contrast to the rotor body of FIGS. 3 and 4, the intake port 103 leads via intake channel 104 to both axial ends of the rotor body 102 and opens (105) in both concave axial surfaces 106*a,* 110*a* near the central load bearing shaft 112. The concave surface zones 106*a* and 110*a* have a smaller diameter than those of the first embodiment and, accordingly, the hereto radially outwardly adjoining ring surface zones 106*b* and 110*b* have a greater radial extension.

A total of six exhaust bores 109 extend in axial direction through the rotor body 102 in angularly spaced apart relationship to open in the ring surface zones 106*b,* 110*b*. The exhaust bores 109 are confined within a sector, to the circumferential rotor surface of which comprises the exhaust port 107 of the rotor body 102. The exhaust port 107 is in fluid communication with each of these exhaust ports 109 via a common exhaust channel 108. Accordingly, the rotor body 102 illustrated in FIG. 7 and 8 provides two radially spaced apart zones for air/charge intake and exhaust gas expulsion, respectively, in both orientations along the axis of rotation of the rotary valve.

Three angularly spaced apart passages 117 extend axially through the rotor body 102 open in both concave surfaces 106*a,* 110*a*. These passages 117 allow fluid passage in axial direction through the rotor body 102 within the central zone surrounding the shaft 112, thus dispensing with the necessity of having to provide separate intake manifold line in the cylinder head for each (or each two) rotary valve elements as described above with reference to FIG. 6.

Figure 9:
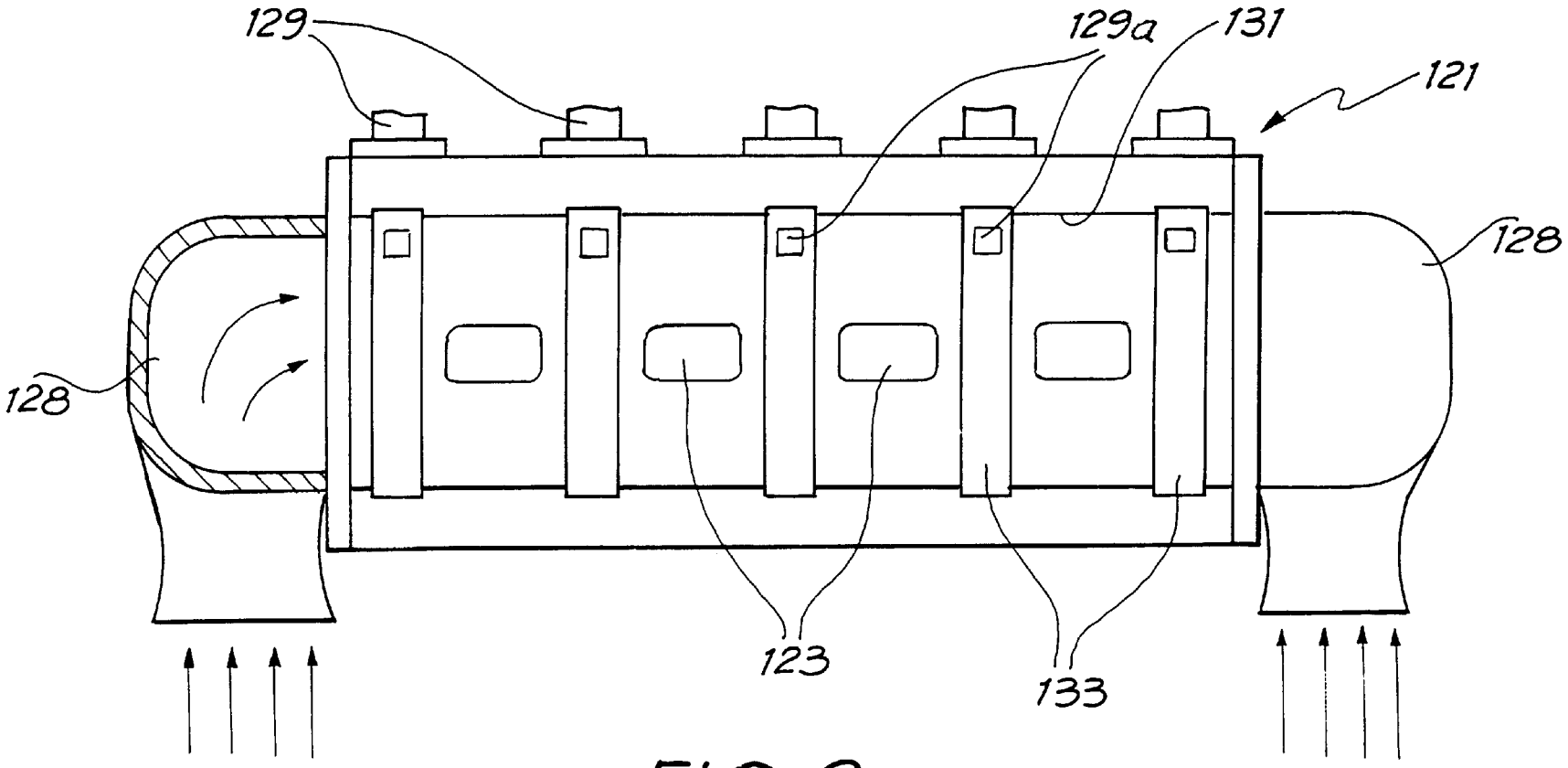
FIG. 9 is a schematic plan top view of a lower cylinder head section of a cylinder head rotary valve assembly for a four-cylinder internal combustion engine for use with four rotary valves as illustrated in FIGS. 7 and 8.

FIG. 9 schematically illustrates the lower section 121 of a cylinder head 120 which is adapted to received four rotary valves according to FIG. 7, 8. As can be seen there, one intake manifold branch 128 is arranged on either axial end of the cylinder head section 121 to provide a common intake means for air/charge in axial flow direction into the valve bore 131 in which the rotary valves are to be mounted as described hereinlater. The cylinder head is intended for a four cylinder engine and, therefore, has four transfer ports 123 in the valve bore surface 131, for respective communication with an associated combustion chamber of the four cylinders of the engine.

Inbetween neighbouring and at either side of the axially outermost transfer ports 123 are located slots 133, each adapted to receive a bearing support plate 140 (see FIGS. 10–12), as will be described hereinbelow, for rotatably mounting the rotor valve members in the cylinder head section 121. Within each slot 133 is located an exhaust manifold port 129*a* leading into the exhaust manifold system of the cylinder head.

Figure 10:
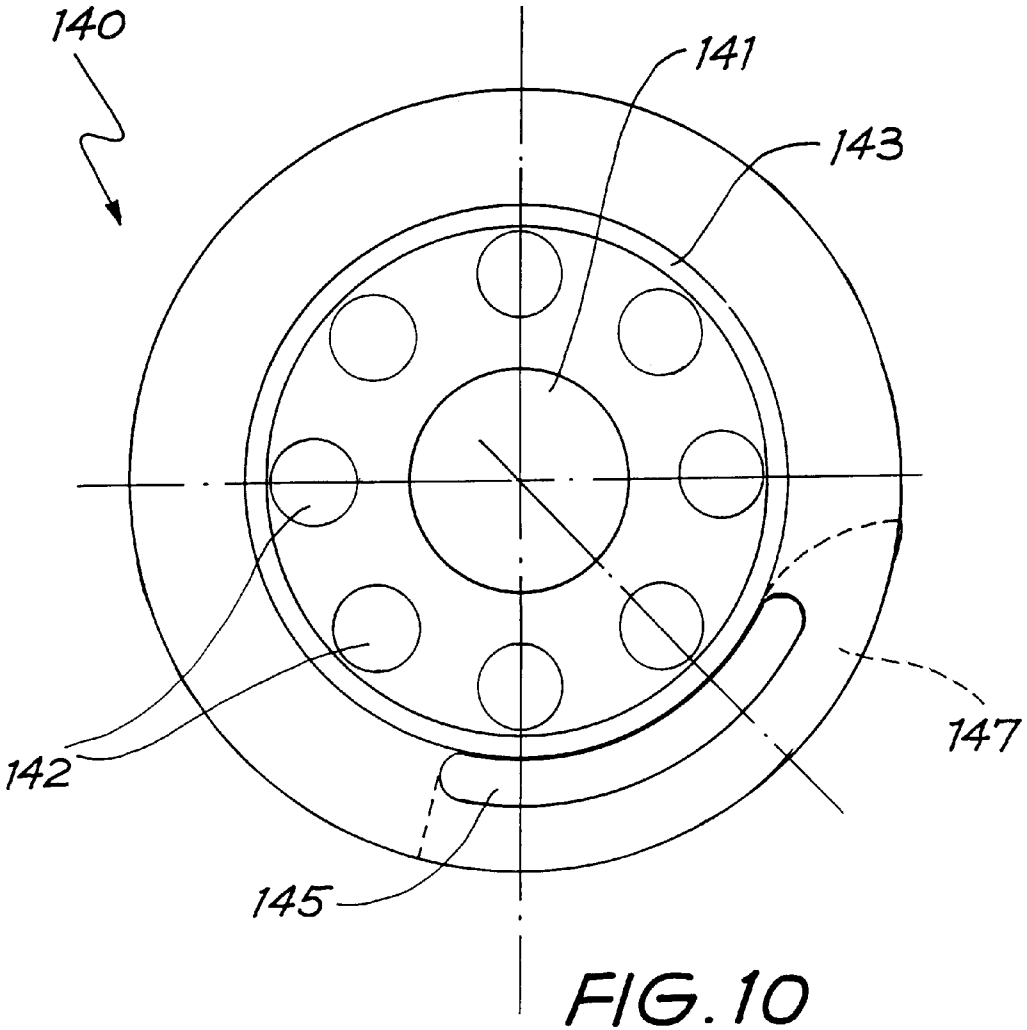
FIG. 10 is a plan view in axial direction of a support plate for rotatably mounting the rotary valves illustrated in FIGS. 7 and 8 in the cylinder head section illustrated in FIG. 9.
Figure 11:
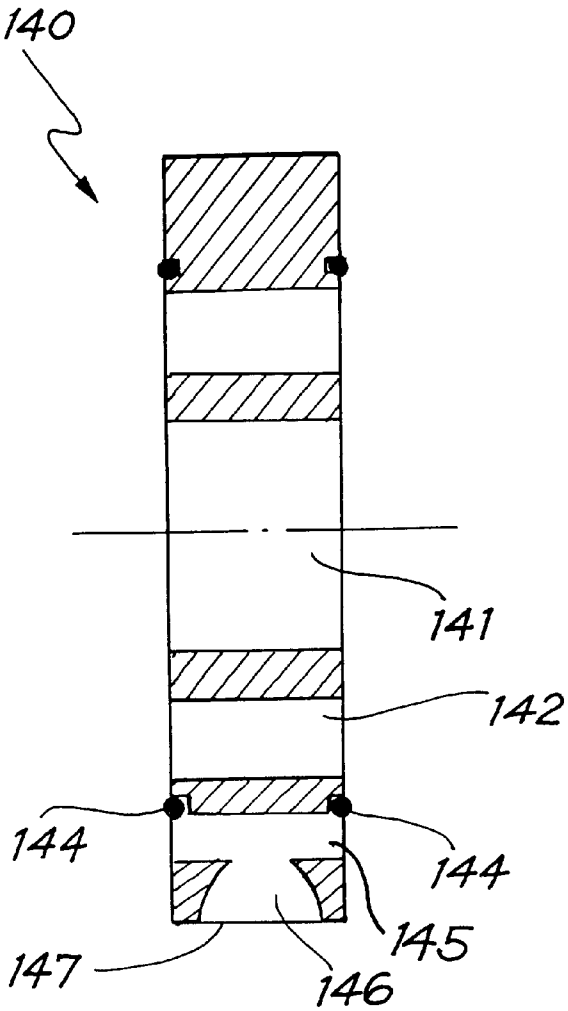
FIG. 11 is a section of the support plate along arrows e–f in FIG. 10.

FIGS. 10 and 11 illustrate a bearing support plate 140 having a central bore 141 for receiving and fixing therein a roller bearing or journaled coupling for the load bearing shaft of two rotary valves to be supported by each support plate within the lower cylinder section illustrated in FIG. 9.

The support plate 140 is also provided with a plurality of angularly spaced apart air/charge passage holes 142 surrounding the central bore 141 and extending axially through the plate at a radial location such as to lie within the diameter of the concave surface zone 110*a,* 116*a* and allow fluid communication with the passages 117 and intake opening 105 of the rotor body 102. Thus, fluid communication is not dependent upon registration of said openings in the rotor body with those in the support plate, but is constant because the recessed concave axial ends of the rotor body provide supply chambers for said openings, as can be also seen in FIG. 12. An annular groove 143 is provided on each axial surface of the support plate 140 encircling the passage holes 142 and adapted to receive a sealing ring 144. The slide fit between groove 143 and sealing ring 144 is such as to allow rotation of the sealing ring within the groove.

The support plate 147 is further provided with an arcuate slot 145 of predetermined circumferential extension and extending axially through the plate such as to open via an exhaust cavity 146 in a radial opening 147 in the circumferential surface of the support plate 140. The radial location and length of the arcuate slot 145 is chosen such as to coincide with the radial location of the exhaust bores 109 of the rotor body 102 and the length of the sector in which these exhaust bores 109 are located.

Thus, as can be best seen in the schematic illustration of FIG. 12, and with reference to FIG. 9, each support plate 140 can be mounted in a respective slot 133 in the cylinder head section 121 and fixed against rotation so that the exhaust cavity 146 and its radial opening 147 coincide and sealingly cover the exhaust manifold port 129*a* within said slot 133 to provide fluid communication therebetween. Further, during each complete rotation of the rotary valve 102 which is rotatably supported between two support plates 140, the axial exhaust bores 109 will pass over and register with the arcuate slot 145 of adjacent support plates 140 and thus provide communication between the transfer port 123 and the exhaust manifold port 129*a* of the cylinder head section 121 via the exhaust port 108 and axially extending exhaust bores 109 of the rotor body 102 and the arcuate slot 145 and radial opening 147 of the support plates 140.

The sealing rings 144 received on either side of the support plate 140, which separate the arcuate slot 145 and the passage holes 142 of the support plate 140 abut hereby against the axial end ring surface zones 106*b,* 110*b* of the respectively adjoining rotor body 102 and prevent any substantial cross-leakage of fluids into and from the axial end concave cavities of the rotor body 102 in which the air/charge passages 117 and the axial intake opening 104 of the intake channel 104 are provided.

While the passage holes 142 of the support plates 140 and the through passages 117 in the rotor bodies 102 ensure constant fluid communication in axial direction along adjoining rotary valve members, thus allowing the air/charge for a combustion process to provide efficient continuous cooling of the rotary valves during the exhaust, induction, compression and combustion strokes of the engine, the exhaust manifold is only in timed periodic fluid communication with the combustion chambers of the cylinder via the respective rotary valve members during the respective exhaust stroke of the piston in the associated cylinder.

As has been described above, one important feature of the present invention is to provide a rotary valve with a system of discrete sealing frames which rotate with the rotary valve and which effectively seal off from one another a predetermined given number of surface zones thereon, when the rotary valve is received in the valve bore of the cylinder head, the surface zones correlated with the strokes performed during cycle in the engine. One of these discrete sealing frames is arranged such that the two axially extending sealing blades of this frame come to lie adjacent in circumferential direction to the transfer port edges such as to effectively seal the cylinder combustion chamber by means of said sealing frame and the framed circumferential surface zone of the rotor body during the critical moments immediately prior to and after ignition of the charge in the combustion chamber to which the rotary valve is assigned, that is for about 5°–20° crank shaft rotation after the compression on either side of the pistons top dead centre (TDC). This crank shaft rotation sector corresponds to the final stages of the compression stroke and the initial stages of the combustion stroke of the piston. Also, discrete sealing frames are provided to surround the exhaust and intake ports of the rotary valves and increase overall sealing efficiency.

Figure 15:
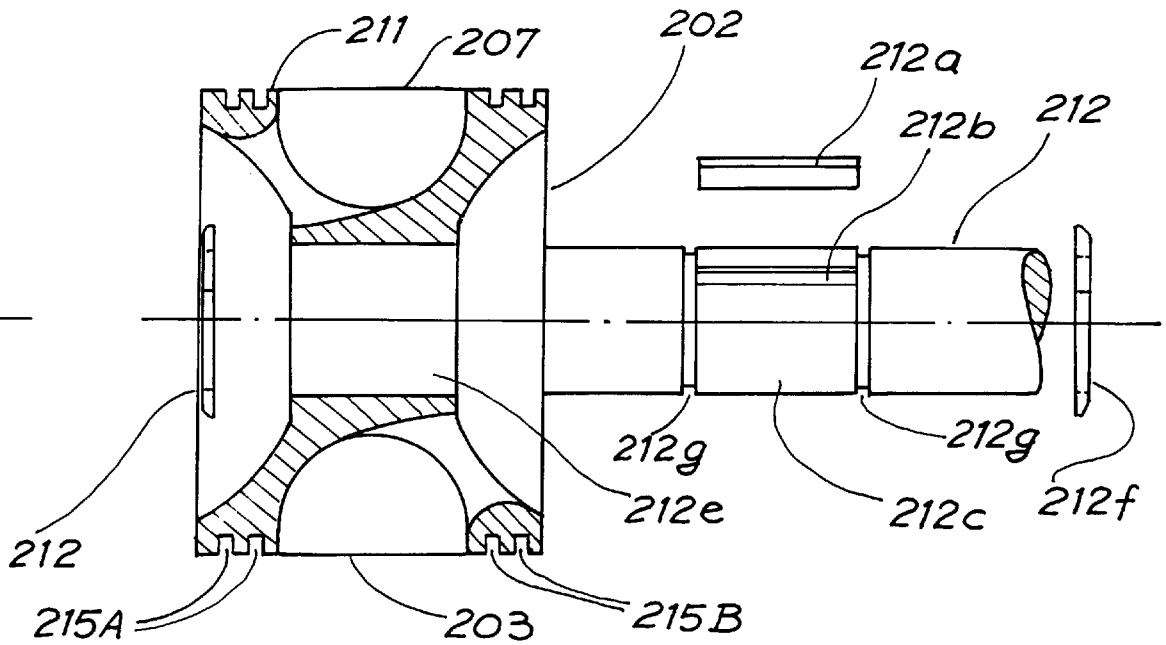
FIG. 15 is a longitudinal section of a rotary valve in a second embodiment in accordance with the invention, the valve comprising a rotor body and a separate load bearing shaft onto which the rotor is mounted.
Figure 16:
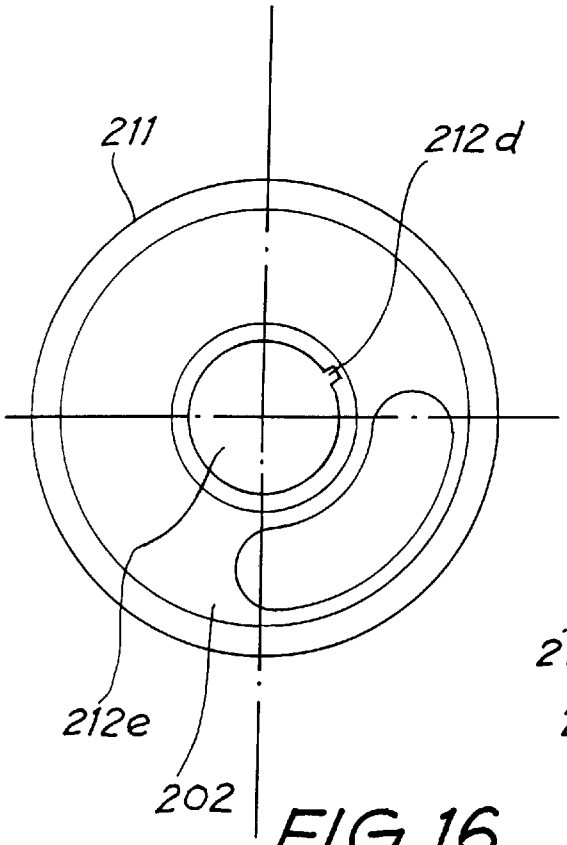
FIG. 16 is an axial plan view of the rotor body illustrated in FIG. 16.

A further (second) embodiment of a rotary valve in accordance with the present invention is illustrated schematically in FIGS. 15 and 16. But for the differences noted below, the rotor body 202 and the sealing system consisting of sealing rings and blades forming above described discrete sealing frames is similar as described with reference to FIGS. 1–4, and thus reference should be made as well to the description given with reference to those figures.

In modification of the embodiment illustrated in FIGS. 1–4, a total of four annular grooves 215A, 215B are provided on the circumferential surface 211 of the rotor body 202, two grooves each on either side of the exhaust and inlet port 203, 207. The groove 215A and 215B are adapted to each receive one appropriately dimensioned sealing ring (not illustrated) as described with reference to the other two embodiments of the rotor body.

The rotor body 202 is received on a discrete load bearing shaft 212 and secured against rotation thereon by means of a key 212*a* which is received in an axially extending key groove 212*b* in the central zone 212*c* of the shaft 212*d* as well as in a correspondingly shaped key way 216 machine in the inner-peripheral surface of bore 212*e* of the rotor body 202. As will be appreciated, the central zone 212*c* on which the rotor body 202 is received has a slightly smaller diameter to allow a glide fitting between the two parts, whereby the rotor body 202 is secured against axial movement along the axis of the shaft 212 by means of two circlips 212*f* engaging in annular retention grooves 212*g* on either axial side of the rotor body 202.

Otherwise, the rotary valve is as described with reference to FIGS. 1–4.

Figure 17:
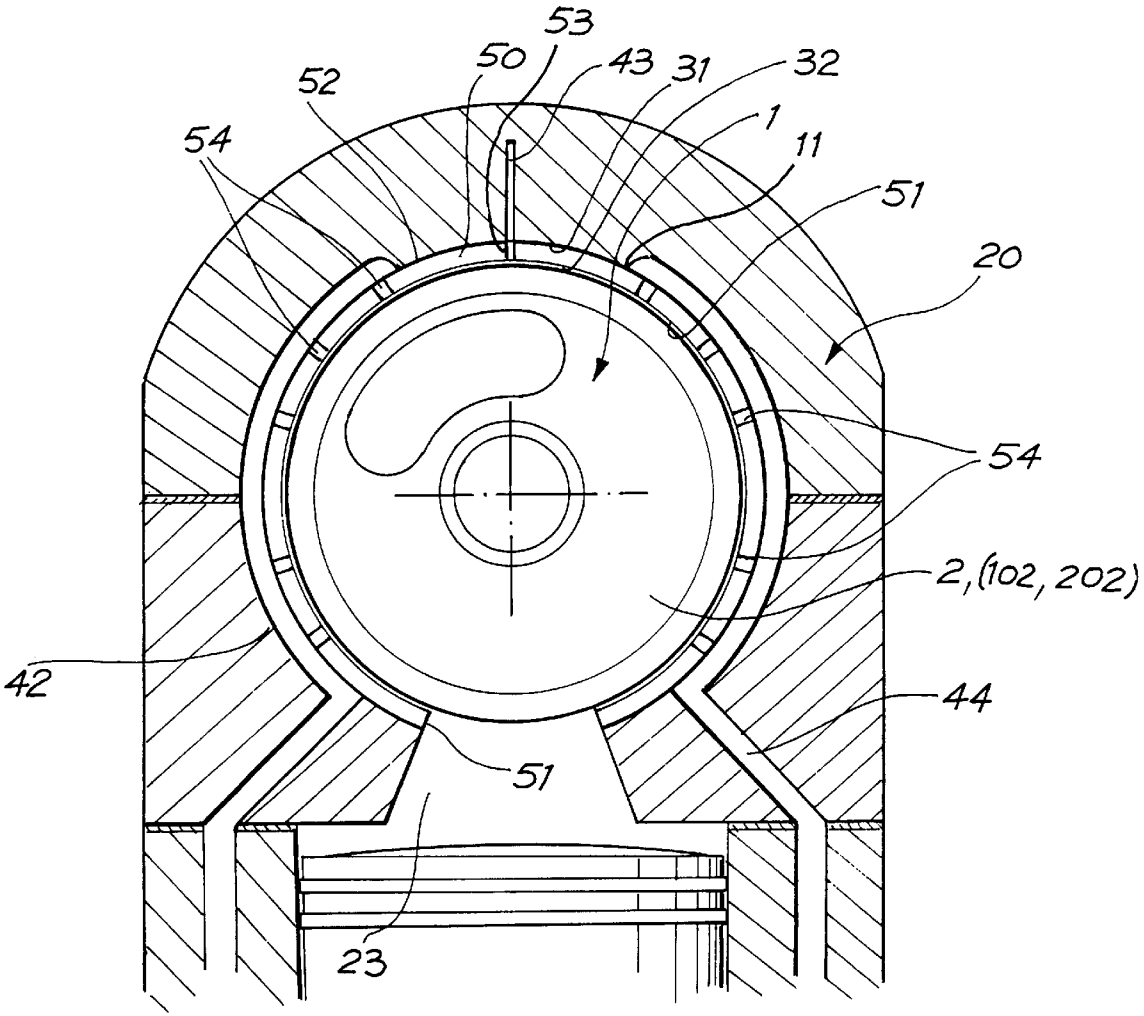
FIG. 17 is a schematic cross-section similar to FIG. 5 through a cylinder head-rotary valve assembly with a replaceable rotary valve liner or bush received within the valve bore in accordance with yet a further embodiment of the present invention.

In FIG. 17 is illustrated a further embodiment of a cylinder head-rotary valve assembly for an internal combustion engine. But for the differences noted below, this assembly is similar to the one illustrated in and described with reference to FIG. 5, and thus, where appropriate, same reference numerals have been used to designate same parts. It will be appreciated that the rotary valve can incorporate a cylindrical rotor body 2, 102 or 202 as illustrated with reference to the different embodiments thereof priorly described. The rotary valve 1 is supported for rotation in the cylindrical valve bore 31 in the cylinder head 20 of the internal combustion engine as priorly described. A replaceable, cylindrical liner 50 is provided for the or each rotary valve rotor. The liner 50 has an outside diameter such that its outer-peripheral surface 52 is in sealing engagement with the inner-peripheral surface of the valve bore 31, preferably with a slight interference fit to prevent rotational movement of the liner 50 within the bore 31; Other known means may be used to prevent rotation and axial movement of the liner 50 within the cavity 31.

A transfer window 51 corresponding in size with the transfer port 23 of the cylinder head 20 extends through the peripheral wall of the liner 50 and is arranged to coincide with said transfer port 23 when mounted in the cylinder head cavity 31. The inner-peripheral surface of the housing cavity 31 is provided with a number of depressions 42 which are arranged to partially surround the liner body 50 and which form cavities for circulating cooling or lubricating fluid; individual cavities 42 are in fluid communication with a common drainage channel 44 extending through the cylinder head 20 and communicating with a similar drainage channel of the engine's cylinder body 27.

Figure 18:
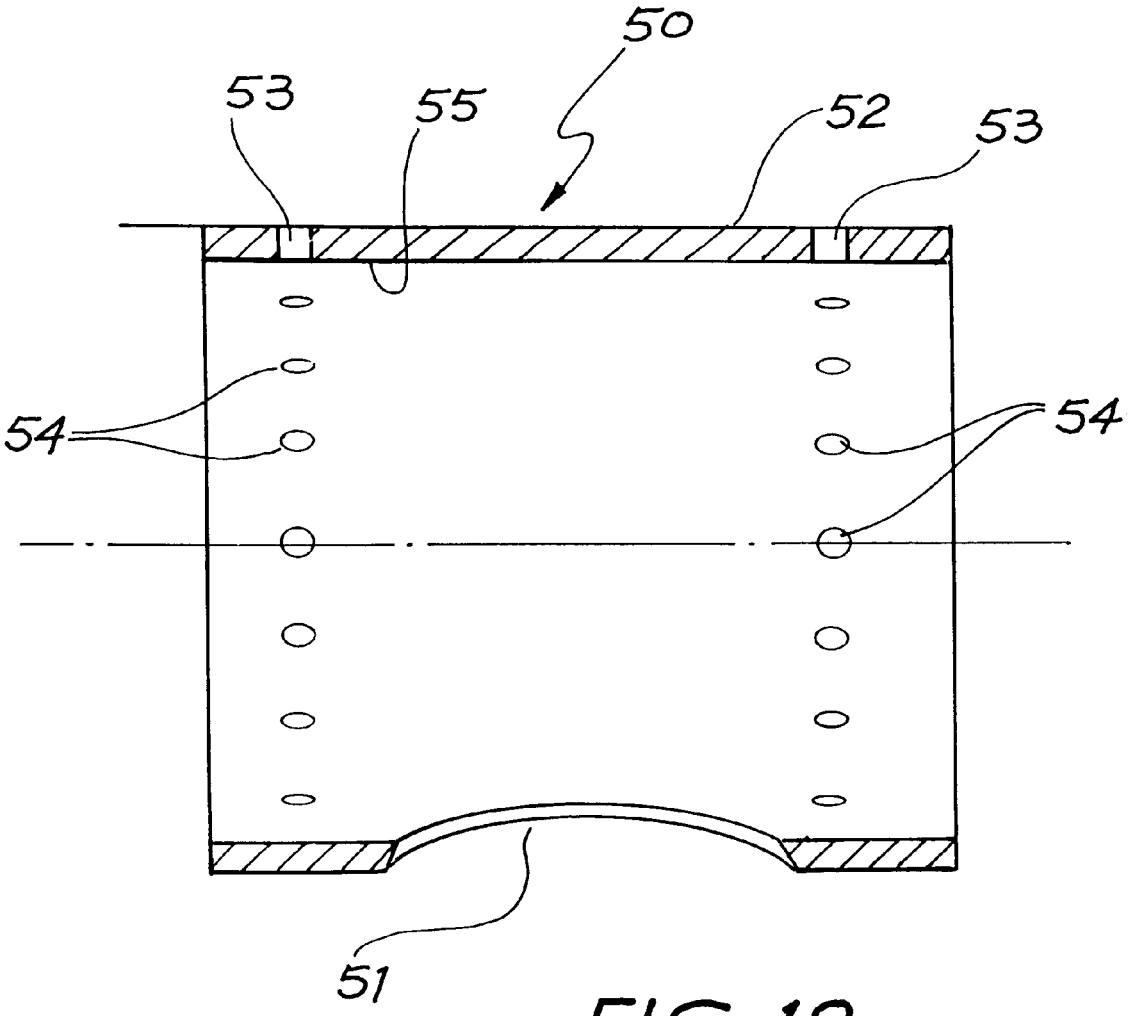
FIG. 18 is a longitudinal section of the rotary valve liner illustrated in FIG. 17.

The valve liner 50 is provided diametrically opposite the transfer window 51 with two oil feeding holes 53 (see also FIG. 18) extending through the peripheral wall and which are in fluid communication with a oil feeding channel 43 of the cylinder head housing 20. Further, a plurality of oil drainage holes 54 extending radially through the liner wall are arranged angularly spaced from one another and located such as to be in fluid communication with the cavities 42 of the cylinder head housing 20. The inside diameter of the cylindrical liner 50 is sized such that the cylindrical rotor body 2, 102, 202 of the rotary valve 1 is received with a predetermined clearance fit to provide for the small radial clearance gap 32 between the circumferential outer surface 11 of the rotor body 2, 102, 202 and the internal circumferential surface 55 of the cylindrical liner 50, in similar fashion as was described with reference to the embodiment illustrated in FIG. 5.

Advantageously, the material of the liner or bush 50 is selected such as to provide adequate wear resistance for the sealing elements (rings and blades) (see FIG. 1) which provide the sealing frames previously described. Currently, it is believed that sintered cast iron or metal-ceramic composite materials will provide such adequate wear resistance.

In operation of the rotary valve, cooling and/or lubricating fluid is fed via oil feeding channel 43 and oil feeding bores 53 into the gap 32 between the outer peripheral surface 11 of the rotor body 2 and the innerperipheral surface 55 of the cylindrical liner 50. Here, the cooling and/or lubricating fluid, e.g. oil, lubricates and cools the rotor body and sealing elements (sealing rings and sealing blades) and can exit through the liner drain holes 54 into the cylinder head drain cavities 42 from where it can return via drain channel 44 to the sum of the engine.

It will be appreciated by those skilled in the art that the above description of preferred embodiments provides the basic concepts underlining the present invention; specific dimensions and materials of the rotary valve rotor, seals and cylinder head, as well as dimensional inter-relationships of the co-operating ports and openings and surfaces involved in controlling air/charge intake into the combustion chamber during induction, pressure leakage during the ignition phase as well as during the combustion and compression strokes, and gas exhaust during the exhaust stroke can be readily chosen to meet specific requirements.

Also, the rotary valve is not solely intended for use with reciprocating piston, 4-stroke type engines but can be used in other engines such as, for example, having rotary pistons (Wankel). Applications include automotive, industrial and marine engines alike.

We claim:

1. A rotary valve for controlling the supply and exhaust of fluid to and from a combustion chamber of an internal combustion engine, comprising:

a valve rotor having a cylindrical rotor body with an inlet and an outlet channel extending therethrough and which channels respectively end in an inlet and an outlet port formed in circumferentially spaced apart relationship on a circumferential surface of the body and in an inlet and an outlet opening formed in opposite axial end surfaces of the body;

a valve bore having a transfer port in its circumferential surface communicating the interior of the bore with the combustion chamber, the valve rotor being received co-axially within the valve bore so as to maintain a small radial clearance gap between the circumferential surface of the rotor body and the facing valve bore surface, the valve rotor arranged for synchronised rotation with the stroke timing sequence of the operating cycle of the engine such that the inlet and outlet ports pass over the transfer port for periodically enabling fluid exchange therethrough; and a sealing system comprising at least two sealing rings mounted on the rotor body on opposite axial sides of the inlet and outlet ports and a plurality of longitudinal sealing blades mounted on the rotor body and extending between the sealing rings, the sealing rings and blades disposed to bridge the radial clearance gap and rub against the bore surface;

wherein the circumferential surface of the rotor body is notionally subdivided into four circumferentially successively arranged zones corresponding to an induction, a compression, a combustion and an exhaust stroke of the engine operating cycle, wherein the intake port located in the induction zone extends for an arc length of about 1.571 to 2.094 radians, wherein the compression and combustion zones include an ignition zone overlapping both said zones and which has a circumferential length greater than that of the transfer port, and wherein at least one of said sealing blades is located at the beginning of the induction zone, at the beginning and one at the end of the ignition zone, at the beginning of the exhaust zone and between the exhaust and induction zones, respectively, whereby the arrangement of sealing rings, sealing blades and thereby framed valve rotor zones is such that charge compressed during the compression stroke and combustion gases created during the combustion stroke are substantially prevented during these strokes from passing from the transfer port into the inlet and outlet ports and openings of the rotor body and fluid exchange between the inlet and outlet ports of the rotor body is also substantially prevented during these strokes.

2. A rotary valve according to claim 1, wherein the longitudinal sealing blades extend substantially parallel to the axis of rotation of the rotor body, one or more of the sealing blades being received with predetermined fit in an associated one of a plurality of axial grooves formed in the circumferential surface of the rotor body, the sealing blades extending radially outwards from the rotor body to slidingly abut against the bore surface, and wherein the sealing rings are received with predetermined fit in an associated annular groove formed in the circumferential surface of the rotor body on either axial end of the axial grooves and the intake and exhaust ports, the sealing rings being biased to extend radially outwards from the rotor body to slidingly abut against the bore surface.

3. A rotary valve in accordance with claim 2, wherein the axial end surfaces of the rotor body have a recessed central zone forming an intake part-chamber and an exhaust part-chamber, respectively, the inlet and exhaust channels terminating in the respective part-chamber.

4. A rotary valve in accordance with claim 3, wherein the recessed central zone is concave-spherical in shape.

5. A rotary valve in accordance with claim 2, wherein the predetermined fit of the sealing rings in the respectively associated annular grooves is a slide fit that allows rotation of the sealing elements within the annular grooves.

6. A rotary valve in accordance with claim 2, wherein the predetermined fit of the sealing blades in the respectively associated axial grooves is a slide fit allowing centrifugal forces to act on the axial sealing elements thereby to load the axial sealing elements radially outwardly against the valve bore surface upon rotation of the rotor body.

7. A rotary valve in accordance with claim 1, wherein the valve rotor comprises a load bearing shaft for journaling the valve rotor in the cylinder head, the diameter of the shaft being smaller than that of the rotor body.

8. A rotary valve in accordance with claim 7, wherein the load bearing shaft is integral with the rotor body and extends axially from both axial end surfaces thereof.

9. A rotary valve in accordance with claim 1, wherein the sealing blades and rings are dimensioned to provide a small clearance play between surfaces of adjoining sealing elements in a cold engine condition and to provide sliding sealing contact of abutting sealing element surfaces in normal to hot engine conditions.

10. A rotary valve in accordance with claim 1, wherein the sealing rings are piston rings as used in reciprocating type internal combustion engines.

11. A rotary valve in accordance with claim 1, wherein the sealing blades are shaped as narrow rectangular parallelepipeds, the surface of the sealing blade which abuts against the valve bore surface having a radius of curvature corresponding to that of the valve bore.

12. A rotary valve in accordance with claim 1, wherein the axial sealing blades comprise two narrow rectangular parallelepiped sections inter-engaged for sliding movement along their axial extension, and axial biasing means tending to move the two sections in opposite axial directions.

13. A cylinder head rotary valve assembly for an internal combustion engine, comprising:

at least one rotary valve comprising a valve rotor having a cylindrical rotor body with an inlet and an outlet channel extending therethrough and which channels respectively end in an inlet and an outlet port formed in circumferentially spaced apart relationship on a circumferential surface of the body and in an inlet and an outlet opening formed in opposite axial end surfaces of the body, a valve bore having a transfer port in its circumferential surface communicating the interior of the bore with the combustion chamber, the valve rotor being received co-axially within the valve bore so as to maintain a small radial clearance gap between the circumferential surface of the rotor body and the facing valve bore surface, the valve rotor arranged for synchronized rotation with the stroke timing sequence of the operating cycle of the engine such that the inlet and outlet ports pass over the transfer port for periodically enabling fluid exchange therethrough, and a sealing system comprising at least two sealing rings mounted on the rotor body on opposite axial sides of the inlet and outlet ports and a plurality of longitudinal sealing blades mounted on the rotor body and extending between the sealing rings, the sealing rings and blades disposed to bridge the radial clearance gap and rub against the bore surface, wherein the circumferential surface of the rotor body is notionally subdivided into four circumferentially successively arranged zones corresponding to an induction, a compression, a combustion and an exhaust stroke of the engine operating cycle, wherein the intake port located in the induction zone extends for an arc length of about 1.571 to 2.094 radians, wherein the compression and combustion zones include an ignition zone overlapping both said zones and which has a circumferential length greater than that of the transfer port, and wherein at least one of said sealing blades is located at the beginning of the induction zone, at the beginning and one of the end of the ignition zone, at the beginning of the exhaust zone and between the exhaust and induction zones, respectively, whereby the arrangement of sealing rings, sealing blades and thereby framed valve rotor zones is such that charge compressed during the compression stroke and combustion gases created during the combustion stroke are substantially prevented during these strokes from passing from the transfer port into the inlet and outlet ports and openings of the rotor body and fluid exchange between the inlet and outlet ports of the rotor body is also substantially prevented during these strokes;

a cylinder head body having rotary valve cooling means, cylinder head cooling means, at least one cylindrical cavity forming the valve bore and transfer port, and bearing supports arranged within and/or at opposite axial ends of the cylindrical cavity;

intake manifold means arranged in continuous fluid communication with the inlet port of the valve rotor body via the inlet opening in the rotor body;

exhaust manifold means arranged in continuous or periodical fluid communication with the exhaust port of the rotor body via the exhaust opening of the rotor body;

bearing means for rotatably mounting the rotary valve on the bearing supports in an axially fixed manner; and drive means for coupling the rotary valve with a crank shaft of the engine, the drive means arranged such that the rotary valve is timed with the stroke sequence of the engine and to rotate the valve rotor such that the intake and exhaust ports periodically register with the transfer port to effect charge intake into and exhaust expulsion from a combustion chamber of the engine.

14. A cylinder head-rotary valve assembly according to claim 13, wherein the intake and exhaust manifold means of the cylinder head are designed to be used interchangeably as intake or exhaust manifolds, and wherein the intake and exhaust ports of the valve rotor are substantially equal in size so as to enable the rotary valve to rotate clockwise or anti-clockwise.

15. A cylinder head-rotary valve assembly according to claim 13 and adapted for a multi-cylinder engine of reciprocating type, wherein a plurality of said valve rotor bodies, one per cylinder, are mounted in axially and rotationally fixed attitude with respect to one another on a common load bearing shaft.

16. A cylinder head-rotary valve assembly according to claim 13 and adapted for a multi-cylinder engine of reciprocating type, wherein the assembly comprises a plurality of valve rotors with integral shafts, one per cylinder, and wherein the load bearing shafts of axially adjoining valves are connected by journal couplings so as to maintain an axially and rotationally fixed attitude with respect to one another.

17. A cylinder head rotary valve assembly for an internal combustion engine, comprising:

at least one rotary valve comprising a valve rotor having a cylindrical rotor body with an inlet and an outlet channel extending therethrough and which channels respectively end in an inlet and an outlet port formed in circumferentially spaced apart relationship on a circumferential surface of the body and in an inlet and an outlet opening formed in opposite axial end surfaces of the body, a valve bore having a transfer port in its circumferential surface communicating the interior of the bore with the combustion chamber, the valve rotor being received co-axially within the valve bore so as to maintain a small radial clearance gap between the circumferential surface of the rotor body and the facing valve bore surface, the valve rotor arranged for synchronized rotation with the stroke timing sequence of the operating cycle of the engine such that the inlet and outlet ports pass over the transfer port for periodically enabling fluid exchange therethrough, and a sealing system comprising at least two sealing rings mounted on the rotor body on opposite axial sides of the inlet and outlet ports and a plurality of longitudinal sealing blades mounted on the rotor body and extending between the sealing rings, the sealing rings and blades disposed to bridge the radial clearance gap and rub against the bore surface, wherein the circumferential surface of the rotor body is notionally subdivided into four circumferentially successively arranged zones corresponding to an induction, a compression, a combustion and an exhaust stroke of the engine operating cycle, wherein the intake port located in the induction zone extends for an arc length of about 1.571 to 2.094 radians, wherein the compression and combustion zones include an ignition zone overlapping both said zones and which has a circumferential length greater than that of the transfer port, and wherein at least one of said sealing blades is located at the beginning of the induction zone, at the beginning and one of the end of the ignition zone, at the beginning of the exhaust zone and between the exhaust and induction zones, respectively, whereby the arrangement of sealing rings, sealing blades and thereby framed valve rotor zones is such that charge compressed during the compression stroke and combustion gases created during the combustion stroke are substantially prevented during these strokes from passing from the transfer port into the inlet and outlet ports and openings of the rotor body and fluid exchange between the inlet and outlet ports of the rotor body is also substantially prevented during these strokes;

a sleeve-like cylindrical valve liner forming the valve bore and transfer port;

a cylinder head body having rotary valve cooling means, cylinder head cooling means, at least one cylindrical cavity having a communication port arranged to open into a combustion chamber of the engine, the valve liner being installed in the cylinder head cavity against rotation such that the transfer port and communication port register with one another, bearing supports arranged, within and/or at opposite axial ends of the cylindrical cavity;

intake manifold means arranged in continuous fluid communication with the inlet port of the rotor body via the exhaust opening in the one axial end of the rotor body;

exhaust manifold means arranged in continuous or periodical fluid communication with the exhaust port of the rotor body via the exhaust opening of the rotor body;

bearing means for rotatably mounting the rotary valve on the bearing supports in an axially fixed manner; and drive means for coupling the rotary valve with a crank shaft of the engine, the drive means arranged such that the rotary valve is timed with the stroke sequence of the engine and to rotate the valve rotor such that the intake and exhaust ports periodically register with the transfer port to effect charge intake and exhaust expulsion from the combustion chamber of the engine.

18. A cylinder head rotary valve assembly according to claim 14, wherein the intake and exhaust manifold means of the cylinder head are designed to be used interchangeably as intake or exhaust manifolds, and wherein the intake and exhaust ports of the valve rotor are substantially equal in size so as to enable the rotary valve to rotate clockwise or anti-clockwise.

19. A cylinder head rotary valve assembly according to claim 14 and adapted for a multi-cylinder engine of reciprocating type, wherein a plurality of said valve rotor bodies, one per cylinder, are mounted in axially and rotationally fixed attitude with respect to one another on a common load bearing shaft.

20. A cylinder head rotary valve assembly according to claim 14 and adapted for a multi-cylinder engine of reciprocating type, wherein the assembly comprises a plurality of valve rotors with integral shafts, one per cylinder, and wherein the load bearing shafts of axially adjoining valves are connected by jounal couplings so as to maintain an axially and rotationally fixed attitude with respect to one another.

* * * * *

UNITED STATES PATENT AND TRADEMARK OFFICE

CERTIFICATE OF CORRECTION

PATENT NO. : 5,941,206

DATED : August 24, 1999

INVENTOR(S) : Brian Smith and Wayne Smith

It is certified that error appears in the above-identified patent and that said Letters Patent is hereby corrected as shown below:

Title Page: the inventors' postal code "2670" should read -- 2570 --;
Title Page: in the Abstract, line 10, after "sealed off", insert -- . --;
Column 19, Claim 14, line 1, "head-rotary" should read -- head rotary --;
Column 19, Claim 15, line 1, "head-rotary" should read -- head rotary --; and
Column 19, Claim 16, line 1, "head-rotary" should read -- head rotary --.

Signed and Sealed this

Twenty-fifth Day of April, 2000

*Attest:*

*Attesting Officer*

Q. TODD DICKINSON

*Director of Patents and Trademarks*